US012740651B2

(12) United States Patent
Leng

(10) Patent No.: US 12,740,651 B2
(45) Date of Patent: Sep. 22, 2026

(54) ELASTIC MODULE UNIT, ELASTIC CUSHION, AND FURNITURE

(71) Applicant: NEW-TEC INTEGRATION (XIAMEN) CO., LTD., Fujian (CN)

(72) Inventor: Luhao Leng, Xiamen (CN)

( * ) Notice: Subject to any disclaimer, the term of this patent is extended or adjusted under 35 U.S.C. 154(b) by 0 days.

(21) Appl. No.: 19/108,892

(22) PCT Filed: Mar. 27, 2023

(86) PCT No.: PCT/CN2023/084063

§ 371 (c)(1),
(2) Date: Mar. 5, 2025

(87) PCT Pub. No.: WO2024/055559

PCT Pub. Date: Mar. 21, 2024

(65) Prior Publication Data

US 2026/0083253 A1 Mar. 26, 2026

(30) Foreign Application Priority Data

Sep. 16, 2022 (CN) ..... 202211129404.1

(51) Int. Cl.
*A47C 27/07* (2006.01)
*A47C 27/045* (2006.01)
(Continued)

(52) U.S. Cl.
CPC ..... *A47C 27/07* (2013.01); *A47C 27/0453* (2013.01); *A47C 27/05* (2013.01); *A47C 27/064* (2013.01)

(58) Field of Classification Search
CPC ..... A47C 27/07; A47C 27/0453; A47C 27/05; A47C 27/064; A47C 23/002; A47C 27/15; A47C 27/06
See application file for complete search history.

(56) References Cited

U.S. PATENT DOCUMENTS 5,787,533 A * 8/1998 Fromme ..... A47C 23/002 5/255
6,101,651 A * 8/2000 Tang ..... A47G 9/10 5/255
(Continued)

FOREIGN PATENT DOCUMENTS

CN 2922638 Y 7/2007
CN 201115547 Y 9/2008
(Continued)

OTHER PUBLICATIONS

English translation of Search Report for International Patent Application No. PCT/CN2023/084063; Date of Mailing: Jun. 20, 2023; 1 page.

*Primary Examiner* — Fredrick C Conley
(74) *Attorney, Agent, or Firm* — Ashurst Perkins Coie US LLP

(57) ABSTRACT

An elastic cushion and an elastic module unit for furniture. The elastic module unit configured for assembling into an elastic cushion, the elastic module unit comprising a fixed base plate and a plurality of elastic modules disposed on the fixed base plate; wherein a side edge of the fixed base plate is provided with a second connecting structure configured to releasably connect an edge fastening device which releasably connects a pad layer of the elastic cushion with the second connecting structure such that the elastic cushion can be formed as an elastic cushion with fully opened sides by means of the edge fastening device, thereby improving the comfort of the elastic cushion, improving the ventilation of the elastic cushion, meanwhile facilitating assembling and disassembling of the elastic cushion, and effectively reducing the storage space of the elastic cushion.

20 Claims, 22 Drawing Sheets

(51) Int. Cl.
*A47C 27/05* (2006.01)
*A47C 27/06* (2006.01)

(56) References Cited

U.S. PATENT DOCUMENTS

| | | | | |
|---|---|---|---|---|
| 7,703,160 | B2 | 4/2010 | Wang | |
| 10,869,559 | B2 | 12/2020 | Leng | |
| 2005/0166319 | A1 | 8/2005 | Lamke | |
| 2018/0325273 | A1* | 11/2018 | Cailley ..... | A47C 23/067 |

FOREIGN PATENT DOCUMENTS

| | | | |
|---|---|---|---|
| CN | 03070571 | A | 5/2013 |
| CN | 103070571 | A | 5/2013 |
| CN | 206596875 | U | 10/2017 |
| CN | 107455992 | A | 12/2017 |
| CN | 207776357 | U | 8/2018 |
| CN | 212698303 | U | 3/2021 |
| CN | 112674540 | A | 4/2021 |
| CN | 112674541 | A | 4/2021 |
| CN | 112674542 | A | 4/2021 |
| CN | 212912489 | U | 9/2021 |

* cited by examiner

ELASTIC MODULE UNIT, ELASTIC CUSHION, AND FURNITURE

FIELD

The present disclosure relates to an elastic cushion, and particularly to an elastic module unit, for furniture.

BACKGROUND

Furniture like beds and sofa beds are typically provided with elastic pads. The elastic pads generally have a certain elasticity to provide an elastic support when people are lying on the beds or sofa beds. As such, the elastic pads can provide a relatively higher comfort than a hard pad.

The existing elastic pad is typically a non-detachably integrated and enclosed pad consisting of a whole piece of base layer, a spring layer, a sponge overlaying layer and an enclosed side surrounding cover. Specifically, the spring layer is disposed on the base layer, the sponge overlaying layer is disposed on the spring layer, and the enclosed side surrounding cover is connected between the sponge overlay layer and the base layer, thereby forming a closed space.

However, such an elastic pad usually has poor comfort. In addition, such an elastic pad is not only costly, but also has poor stability in actual use, thereby reducing the comfort. Even more, it may cause inconvenience in transportation, and will occupy a large space for storage.

SUMMARY

In view of at least some of the above problems existing in the prior art, an objective of the present disclosure is to enhance the comfort of an elastic cushion, improve the ventilation of the elastic cushion, while facilitating the assembly and disassembly the elastic cushion, and effectively reducing the storage space occupied by the elastic cushion.

According to a first aspect of the present disclosure, the objective is achieved by providing an elastic module unit configured for assembling into an elastic cushion. The elastic module unit comprises a fixed base plate and a plurality of elastic modules disposed on the fixed base plate, wherein mutually opposite splicing side edges of the fixed base plate are respectively formed with first connecting structures configured to splice together the fixed base plates of the plurality of elastic module units so that the plurality of elastic module units are assembled into an elastic support layer; wherein a side edge of the fixed base plate is provided with a second connecting structure configured to releasably connect an edge fastening device which releasably connects a pad layer of the elastic cushion with the second connecting structure, such that the elastic cushion can be formed as an elastic cushion with fully opened sides.

In the technical solution described above, since the mutually opposite splicing side edges of the fixed base plates of the elastic module units are respectively formed with the first connecting structures, the fixed base plates of adjacent elastic module units may be spliced together via the first connecting structures when assembling the elastic cushion. In this way, the plurality of elastic module units can be successively spliced and assembled into the elastic support layer, thereby achieving a quick and convenient assembly of the elastic support layer. Then the pad layer is laid on the elastic support layer, and the second connecting structures disposed at the side edge of the fixed base plate are releasably connected with the edge fastening device, such that the edge fastening device releasably connects the second connecting structure with the pad layer, thereby forming the elastic cushion with fully opened sides. Since there is no sealed side surroundings provided, the elastic cushion has a transparent inner structure to have a good ventilation, thereby enhancing the ventilation and comfort of the elastic cushion. When the elastic cushion needs to be collected for storage, the edge fastening devices and the second connecting structures are released, and the fixed base plates are disengaged from each other, so that the elastic cushion can be quickly and conveniently disassembled for storage, thereby effectively facilitating the transportation of the elastic cushion and reducing the storage space of the elastic cushion.

According to one embodiment, the first connecting structures and the second connecting structures are alternately arranged at an interval on at least one of the splicing side edges.

According to another embodiment, the first connecting structures and the second connecting structures on the two splicing side edges have the same cross-sectional shape.

According to a further embodiment, the first connecting structures and the second connecting structures on one of the splicing side edges have the same cross-sectional shape, and the first connecting structures and the second connecting structures on the other of the splice side edges have different cross-sectional shapes.

According to a further embodiment, an extension length of the second connecting structures in an extension direction of the splicing side edges is significantly smaller than that of the first connecting structures extending along the extension direction of the splicing side edges.

According to a further embodiment, the first connecting structures are disposed at both ends of the splicing side edges, wherein an outer end of each of the first connecting structures is provided with the second connecting structure.

According to a further embodiment, the second connecting structure comprises a hanging groove formed on a bottom side of the outer end of the first connecting structure.

According to a further embodiment, the first connecting structures formed on the mutually opposed splicing side edges have the same configuration so that the first connecting structures of the fixed base plates of the plurality of elastic module units can be engaged with a splicing rail to splice the plurality of elastic module units together.

According to a further embodiment, the elastic module unit further comprises a splicing rail configured to be engageable with the first connecting structures, and the fixed base plates of the elastic module units arranged side by side are spliced together by means of the engagement of the first connecting structures with the splicing rail.

According to a further embodiment, the second connecting structures are formed at both ends of the splicing rail, respectively.

According to a further embodiment, the first connecting structure comprises a first horizontal side edge extending outwardly from the fixed base plate and a vertical snap tab connected to a suspended end of the first horizontal side edge, two opposite longitudinal sides of the splicing rail are respectively formed with snap sliding grooves having groove openings and being configured to enable adjacent first horizontal side edges to enter through the groove openings and engage with adjacent vertical snap tabs.

According to a further embodiment, the first connecting structures formed on the opposed splicing side edges have configurations which are shaped differently but can cooperate with each other, so that the fixed base plates of adjacent elastic module units in the plurality of elastic module units can be directly spliced together by means of the engagement of the first connecting structures with each other.

According to a further embodiment, the first connecting structure of the splicing side edge located on one side comprises a first horizontal side edge extending outwards from the fixed base plate and a vertical snap tab connected to the suspended end of the first horizontal side edge, and the first connecting structure of the splicing side edge located on the other side comprises a snap sliding groove having a groove opening, so that the first horizontal side edge of one elastic module unit of the plurality of elastic module units extends through the groove opening of another adjacent elastic module unit into the snap sliding groove, leading to the engagement of the vertical snap tab of said one elastic module unit is in the snap sliding groove of another adjacent elastic module unit.

According to a further embodiment, the fixed base plate is formed with a plurality of mounting openings arranged at an interval, each of the plurality of elastic modules is mounted on a corresponding one of the mounting openings, and an internal cavity of the elastic module is in communication with the corresponding mounting opening, so that the plurality of elastic module units can be successively nested and stacked in a manner of passing each elastic module of one elastic module unit through a corresponding mounting opening of another elastic module unit into the internal cavity.

According to a further embodiment, the elastic module comprises a cloth pocket and a spring, wherein an interior of the cloth pocket forms the internal cavity, one end of the cloth pocket is connected to the fixed base plate, and the spring is disposed in the cloth pocket in a pre-compressed state.

According to a further embodiment, the elastic module comprises a spring and a frame having the internal cavity, wherein the frame comprises a top cover, a bottom ring connected to the fixed base plate, and a plurality of connection strips arranged spaced apart along a circumference of the frame and extending between the top cover and the bottom ring, and wherein the spring is disposed in the frame in a pre-compressed state.

According to a second aspect of the present disclosure, the above objective is achieved by providing an elastic cushion comprising a pad layer and a plurality of elastic module units according to any one of the first aspect described above, wherein the fixed base plates of the plurality of elastic module units are spliced together with the first connecting structures to assemble into an the elastic support layer, and the pad layer is laid on the plurality of elastic modules of the elastic support layer; and wherein the second connecting structures and an outer edge of the pad layer are connected by the edge fastening device such that the elastic cushion can be formed as an elastic cushion with fully opened sides.

As stated above, the fixed base plates of adjacent elastic module units can be spliced together via the first connecting structures. In this way, the plurality of elastic module units can be successively spliced and assembled into the elastic support layer, thereby achieving a quick and convenient assembly of the elastic support layer. After the pad layer is laid on the elastic support layer, the second connecting structure and the pad layer are connected via the edge fastening device, thereby fixing the pad layer on the elastic support layer and form the elastic cushion with fully opened sides. Since there is no sealed side enclosure provided, the elastic cushion has a transparent inner structure which make the cushion to have a good ventilation, thereby enhancing the ventilation and comfort of the elastic cushion. When the elastic cushion needs to be collected and stored, the edge fastening devices and the second connecting structures are released, and the fixed base plates are disengaged from each other, so that the elastic cushion can be quickly and conveniently disassembled for storage. This can effectively facilitate the transportation of the elastic cushion and can reduce the storage space of the elastic cushion.

According to one embodiment, the pad layer comprises a stop ring extending from a lower surface of the pad layer towards the elastic modules, the stop ring blocks the outermost elastic module, and the stop ring is connected with the second connecting structure via the edge fastening device.

According to another embodiment, the pad layer is a material layer that can be folded or rolled up.

According to a further embodiment, the pad layer comprises a plurality of elastic pad blocks arranged in a lengthwise direction of the elastic cushion, and the adjacent elastic pad blocks are connected by a thinned flexible hinge portion.

According to a further embodiment, the flexible hinge portion comprises a groove formed on a pad layer upper surface and/or a pad layer lower surface of the pad layer and extending in the widthwise direction of the elastic cushion.

According to a further embodiment, the edge fastening device comprises a connecting rope that can be releasably connected.

According to a further embodiment, the elastic cushion comprises a balancing pad which is laid on the plurality of elastic modules in a height direction of the elastic cushion and can limit transverse movements of the plurality of elastic modules in a transverse direction of the elastic cushion, wherein the pad layer is laid on the balancing pad in the height direction.

According to a further embodiment, an upper surface of the balancing pad (29) facing away from the plurality of elastic modules is formed with a plurality of buffering holes which enables an upper portion of the balancing pad to form a buffering layer portion, wherein each of the buffering holes has a hole bottom wall, and each buffering hole is aligned with one corresponding elastic module.

According to a further embodiment, the pad layer and the balancing pad are connected by a positioning structure disposed therebetween.

According to a further embodiment, the positioning structure comprises a hook and loop disposed on the pad layer lower surface of the pad layer and/or on a balancing pad upper surface of the balancing pad.

According to a further embodiment, a supporting member is provided between the elastic modules in an edge region of the elastic cushion in a peripheral direction of the elastic cushion.

According to a further embodiment, the elastic cushion serves as an elastic mattress.

According to a third aspect of the present disclosure, the above objective is achieved by providing a furniture comprising the elastic cushion according to any one of the second aspect described above.

In addition, the furniture comprises, but is not limited to, beds, sofas, chairs, sofa beds, soft-packed benches, and the like.

It is evident that elements or features described in a single embodiment above may be used alone or in combination in other embodiments.

BRIEF DESCRIPTION OF THE DRAWINGS

In the figures, sizes and proportions do not represent sizes and proportions of actual products. The figures are merely illustrative, and certain unnecessary elements or features have been omitted for the sake of clarity.

Description of Reference Numerals

Figure 1:
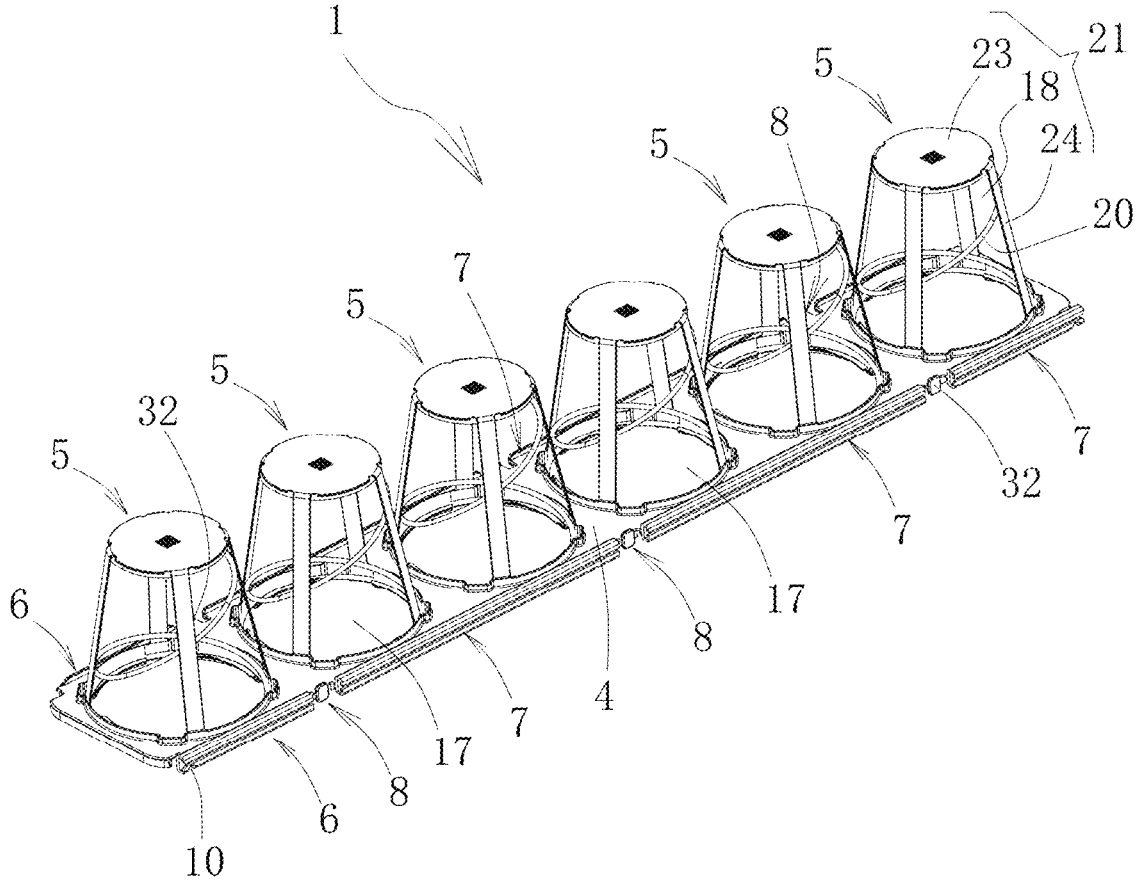
FIG. 1 is a perspective view exemplarily illustrating a first type of elastic module units according to the present disclosure.
Figure 2:
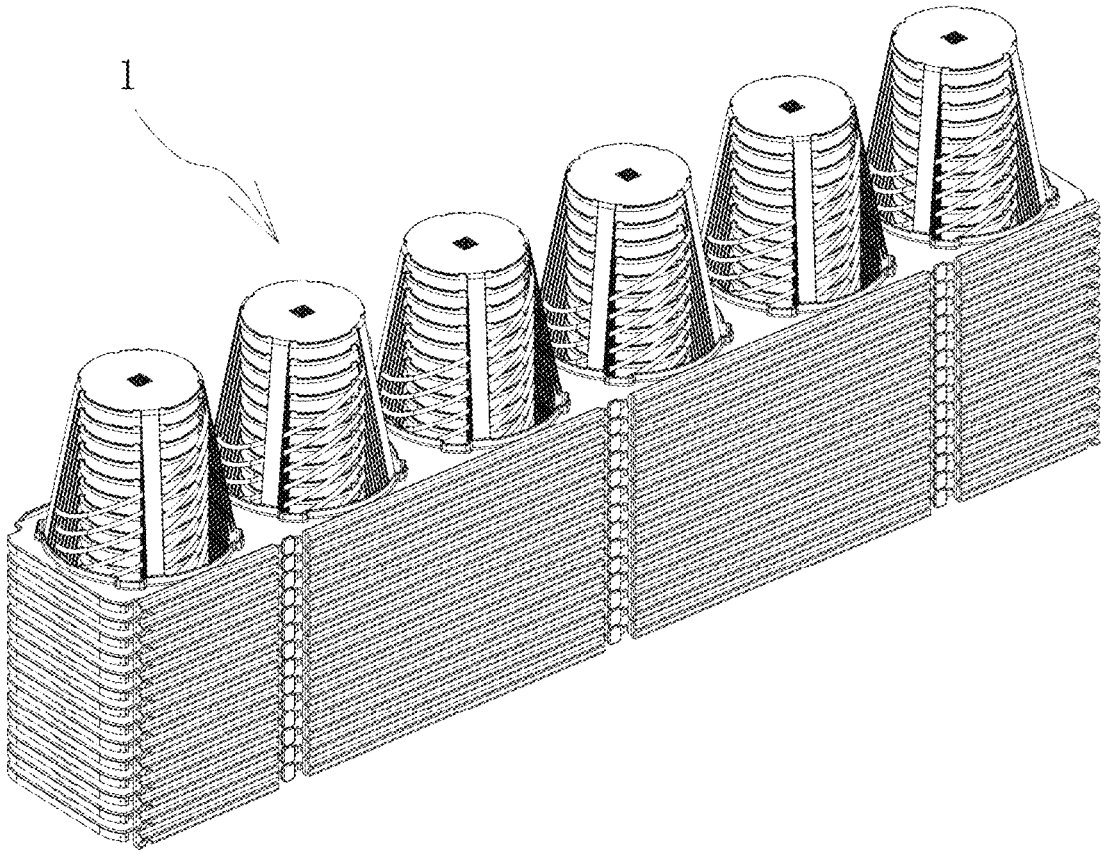
FIG. 2 is a perspective view showing a plurality of the elastic module units of FIG. 1 successively nested and stacked.

1—elastic module unit, 2—pad layer, 3—elastic cushion, 4—fixed base plate, 5—elastic module, 6—splicing side edge, 7—first connecting structure, 8—second connecting structure, 9—edge fastening device, 10—hanging groove, 11—splicing rail, 12—first horizontal side edge, 13—vertical snap tab, 14—snap sliding groove, 15—groove opening, 16—second horizontal side edge, 17—mounting opening, 18—internal cavity, 19—cloth pocket, 20—spring, 21—frame, 22—buffering hole, 23—top cover, 24—connecting strip, 25—stop ring, 26—elastic pad block, 27—groove, 28—connecting rope, 29—balancing pad, 30—hook and loop, 31—elastic support layer, 32—hanging snap, 33—pressing ring, 34—pressing groove.

DETAILED DESCRIPTION OF EMBODIMENTS

Hereunder, the elastic module unit, the elastic cushion and the furniture of the present disclosure will be described in detail with reference to the accompanying drawings. What has been described herein is merely preferred embodiments according to the present disclosure. Those skilled in the art can conceive of other ways of implementing the present disclosure on the basis of the preferred embodiments, and said other ways also fall within the scope of the present disclosure.

With reference to different elastic module units 1 shown in FIG. 1, FIG. 12, FIG. 20 and FIG. 27, in a first aspect, the elastic module units 1 according to the present disclosure are configured for assembling into an elastic cushion 3, for example, the elastic cushion 3 may be used for making furniture articles. The elastic module unit 1 comprises a fixed base plate 4 and a plurality of elastic modules 5 disposed on the fixed base plate 4; wherein mutually opposite splicing side edges 6 of the fixed base plate 4 are respectively formed with a first connecting structure 7. The first connecting structure 7 is configured to splice the fixed base plates of the plurality of elastic module units 1 together so that the plurality of elastic module units 1 are assembled into an elastic support layer 31; wherein the side edge of the fixed base plate 4 is provided with a second connecting structure 8, the second connecting structure 8 is configured to releasably connect an edge fastening device 9, and the edge fastening device 9 releasably connects the pad layer 2 of the elastic cushion 3 with the second connecting structure 8 such that the elastic cushion 3 can be formed as an elastic cushion with fully opened sides by means of the edge fastening device 9, i.e. without a sealing side enclosure.

In the elastic module unit 1 described above, since the mutually opposite splicing side edges 6 of the fixed base plate 4 of the elastic module unit 1 are respectively formed with the first connecting structures 7, the fixed base plates 4 of adjacent elastic module units 1 may be spliced together via the respective first connecting structures 7 when assembling the elastic cushion. In this way, the plurality of elastic module units 1 can be successively spliced and assembled into an elastic support layer 31, thereby achieving a quick and convenient assembly of the elastic support layer 31. Then the pad layer 2 is laid on the elastic support layer 31, and the second connecting structures 8 disposed at the side edge of the fixed base plate 4 are releasably connected to the edge fastening devices 9, such that the edge fastening devices 9 releasably connect the second connecting structures 8 with the pad layer 2, thereby forming the elastic cushion with fully opened sides. Since there is no sealed side surroundings provided, the elastic cushion has a transparent inner structure to have a good ventilation, thereby enhancing the ventilation and comfort of the elastic cushion 3. When the elastic cushion needs to be collected for storage, the edge fastening devices 9 and the second connecting structures 8 are released, and the fixed base plates 4 are disengaged from each other, so that the elastic cushion can be quickly and conveniently disassembled for storage, thereby effectively facilitating the transportation of the elastic cushion and reducing the storage space of the elastic cushion.

In addition, the mutually opposite splicing side edges 6 of the fixed base plate 4 may be lengthwise side edges or widthwise side edges of the fixed base plate 4. In addition, the second connecting structures 8 may be provided on the lengthwise side edges and/or widthwise side edges of the fixed base plate 4.

In addition, in some embodiments, the second connecting structures 8 may be formed at side edges of an upper surface of the fixed base plate 4. In other embodiments, referring to FIG. 1, the second coupling structures 8 may be formed on a side peripheral surface of the fixed base plate 4.

In addition, in some embodiments, referring to FIG. 1, FIG. 12, FIG. 20 and FIG. 27, on at least one splicing side edge 6, the first connecting structures 7 and the second connecting structures 8 are alternately arranged at an interval. As such, it may be ensured that the edge fastening devices 9 more evenly connect the pad layer 2 with the elastic support layer 31 in a peripheral direction of the elastic cushion while ensuring stable splicing of the fixed base plates 4 of the plurality of elastic module units 1. In a preferred embodiment, the first connecting structures 7 and the second connecting structures 8 are alternately arranged at an interval on the two splicing side edges 6. As such, the first connecting structures 7 and the second connecting structures 8 are alternately arranged at an interval on opposite sides of each fixed base plate, so that when a plurality of elastic module units 1 are spliced, any one of the plurality of elastic module units 1 may be taken and spliced regardless of the order of taking the plurality of elastic module units 1, thereby effectively shortening the splicing time.

Figure 3:
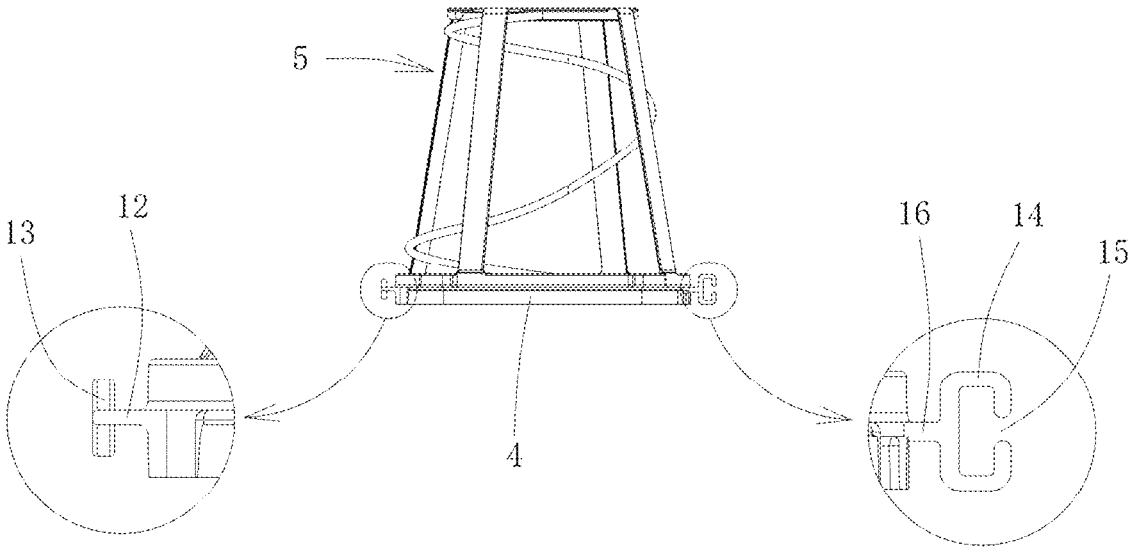
FIG. 3 is a side view of the elastic module unit of FIG. 1, showing two partially enlarged structures.
Figure 12:
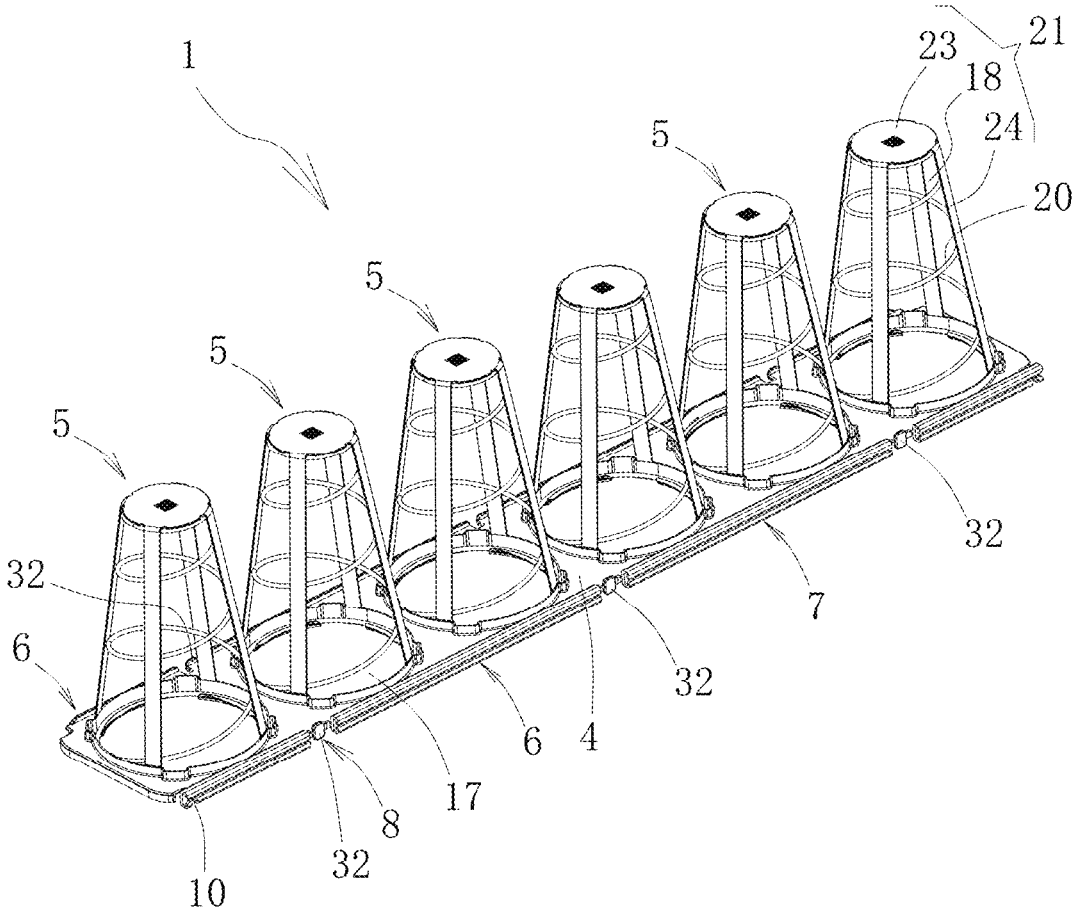
FIG. 12 is a perspective view exemplarily showing a second type of elastic module units according to the present disclosure.
Figure 13:
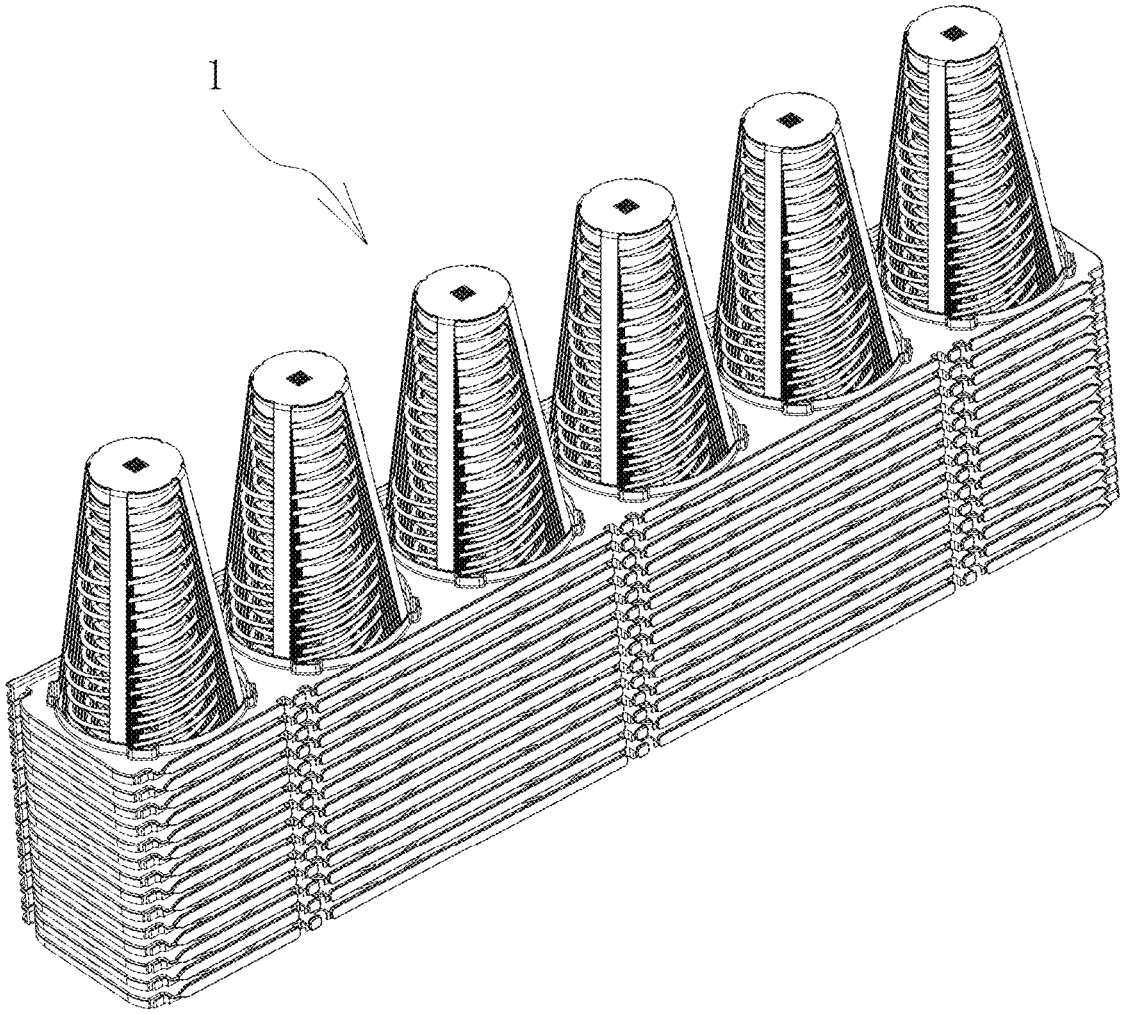
FIG. 13 is a perspective view showing a plurality of the elastic module units of FIG. 12 successively nested and stacked.
Figure 14:
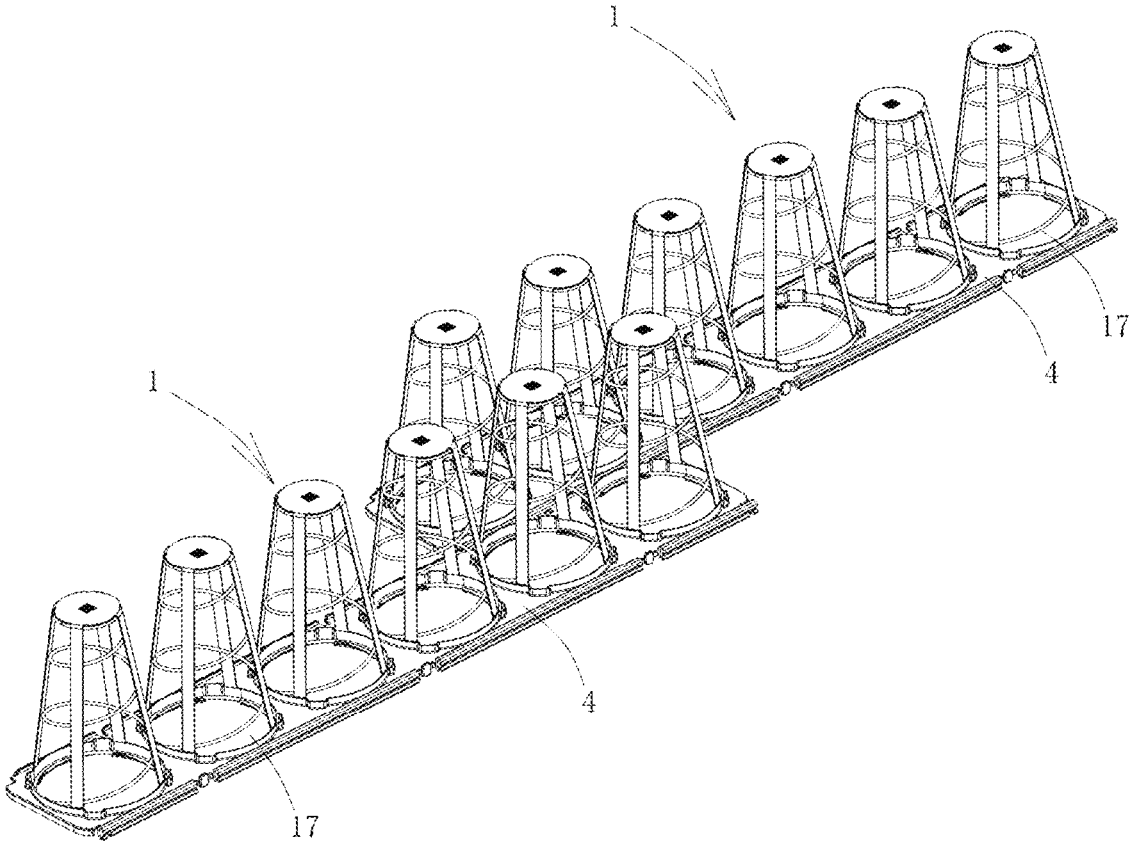
FIG. 14 is a perspective view showing a plurality of elastic module units of FIG. 12 spliced together.
Figure 27:
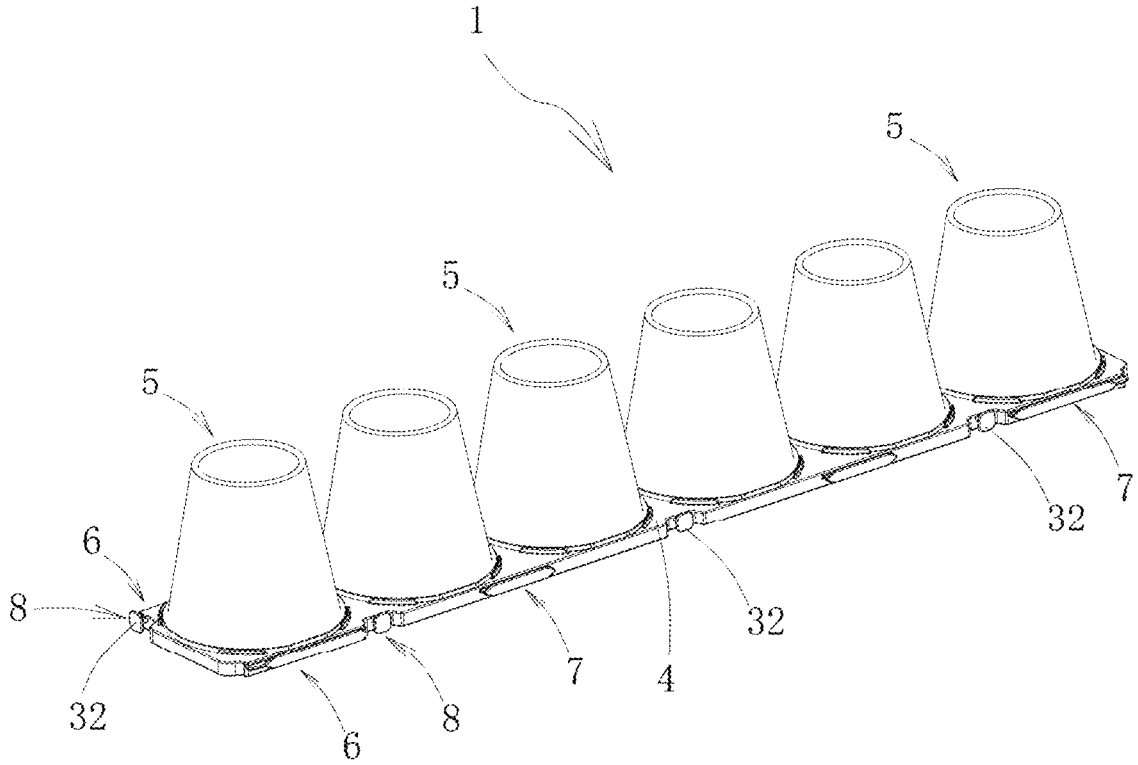
FIG. 27 is a perspective view exemplarily showing a fourth type of elastic module units according to the present disclosure.

In addition, in some embodiments, referring to FIG. 1, FIG. 12, and FIG. 27, the first connecting structures 7 and the second connecting structures 8 on one of the splicing side edges 6 have the same cross-sectional shape, and the first connecting structures 7 and the second connecting structures 8 on the other splicing side edge 6 have different cross-sectional shapes. For example, with reference to FIG. 1 and FIG. 3, the first connecting structure 7 on one side comprises a horizontally disposed T-shaped snap (formed by a first horizontal side edge 12 and a vertical snap tab 13), and the second connecting structure 8 comprises a horizontally disposed T-shaped snap (a form of a hanging snap 32). In this way, the cross-sectional shapes of such a horizontally disposed T-shaped snaps on one side are the same. The first connecting structures 7 on the other side comprises a snap sliding groove 14, and the second connecting structures 8 comprises a hanging snap 32 (for example, a T-shaped snap which may be horizontally placed), so that the cross-sectional shapes of the snap sliding groove 14 and the hanging snap 32 on the other side are different.

Figure 20:
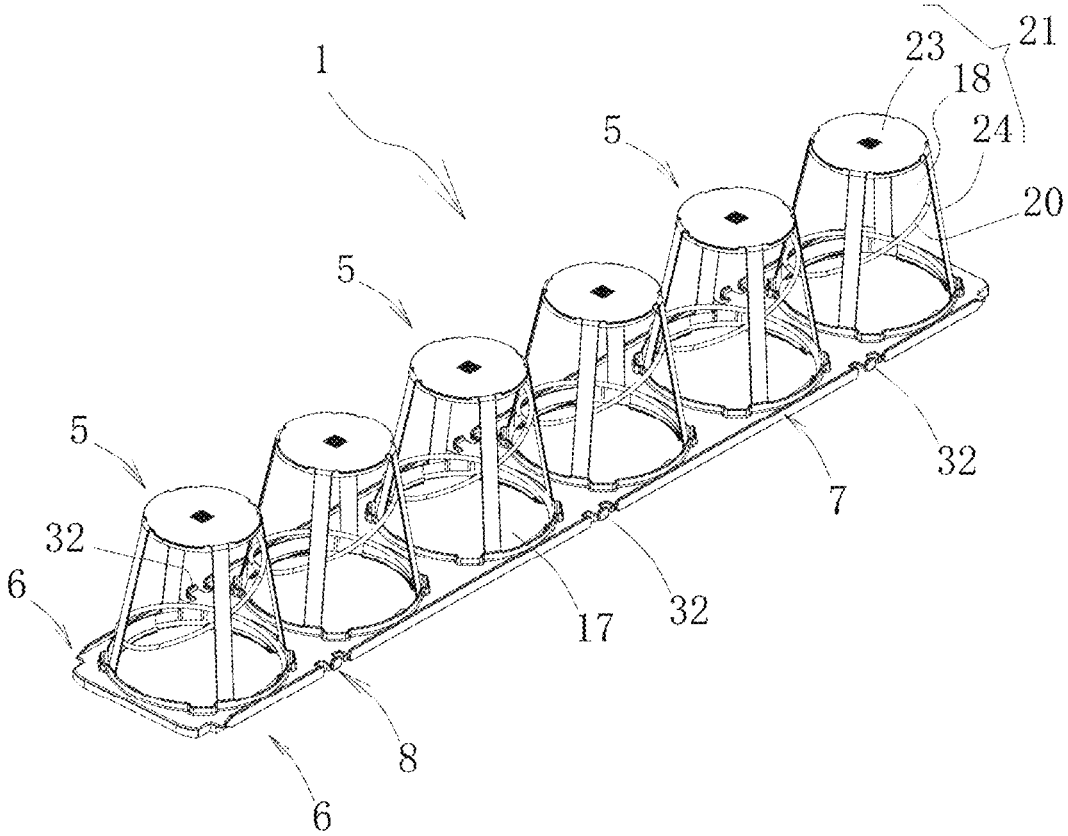
FIG. 20 is a perspective view exemplarily showing a third type of elastic module units according to the present disclosure.

In addition, in some embodiments, referring to FIG. 20, the first connecting structures 7 and the second connecting structures 8 on the two splicing side edge 6 have the same cross-sectional shape. In a preferred embodiment, the first connecting structures 7 and the second connecting structures 8 are flush in a transverse direction of the balancing pad. In this way, the first connecting structures 7 and the second connecting structures 8 may be quickly and easily formed on the splicing side edges 6 of both sides of the fixed base plate 4. For example, the first connecting structure 7 extending from one end to the other may be formed on the splicing side edge 6, and multiple sets of spaced-apart cuts are then cut into the first connecting structure 7, and each set of cuts comprises two spaced-apart cuts. As such, a portion of the first connecting structure 7 between the two cuts of each set of cuts will serve as the second connecting structure 8.

In addition, in some embodiments, an extension length of the second connecting structure 8 may be equal to that of the first connecting structure 7 in an extension direction of the splicing side edge 6. In other embodiments, referring to FIG. 1, along the extension direction of the splicing side edge 6, e.g., the lengthwise direction of the fixed base plate in FIG. 1, the extension length of the second connecting structure 8 is smaller than that of the first connecting structure 7, preferably the extension length of the second connecting structure 8 is significantly smaller than that of the first connecting structure 7 extending along the extension direction of the splicing side edges 6. Thus, since the extension length of the second connecting structure 8 is smaller than that of the first connecting structure 7, the extension length of the first connecting structure 7 may be increased as much as possible within a limited extension length of the splicing side edge 6, thereby effectively improving the splicing stability of the plurality of fixed base plates 4, while the second connecting structure 8 can be releasably connected with the fastening connecting structure 9.

Figure 6:
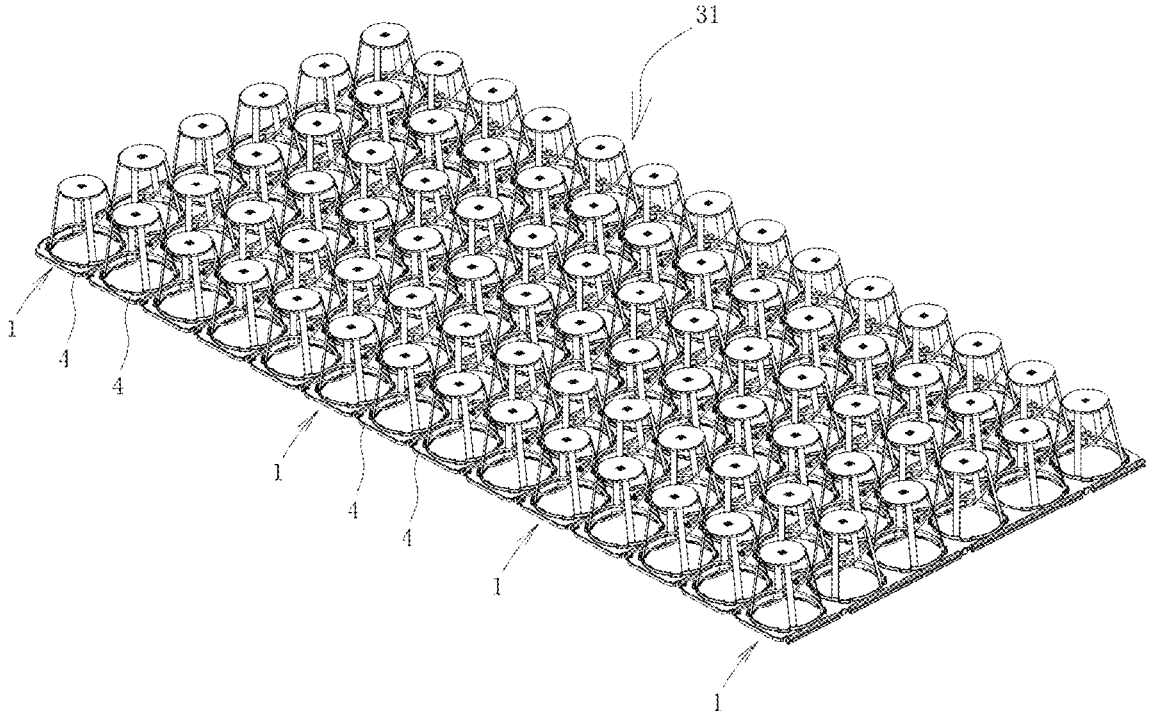
FIG. 6 is a perspective view of an elastic support layer formed by splicing a plurality of elastic module units of FIG. 1 in the splicing manner shown in FIG. 5.
Figure 7:
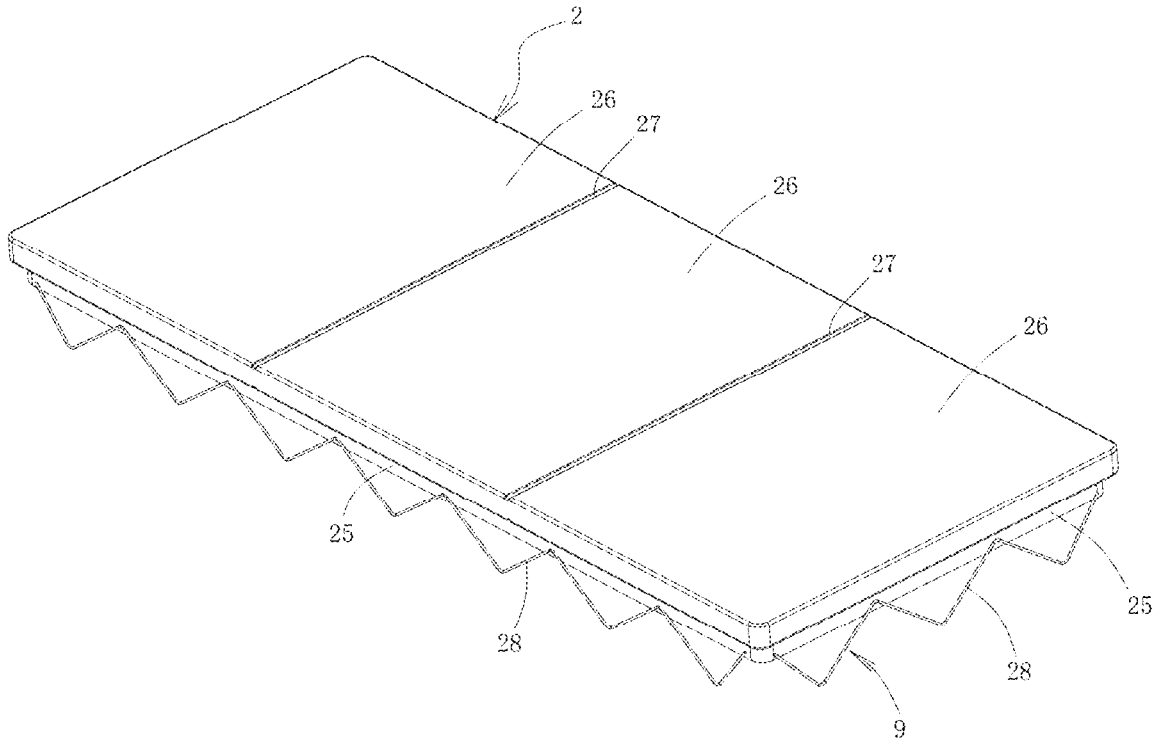
FIG. 7 is a perspective view exemplarily showing a pad layer of a first elastic cushion according to the present disclosure as viewed from top.
Figure 8:
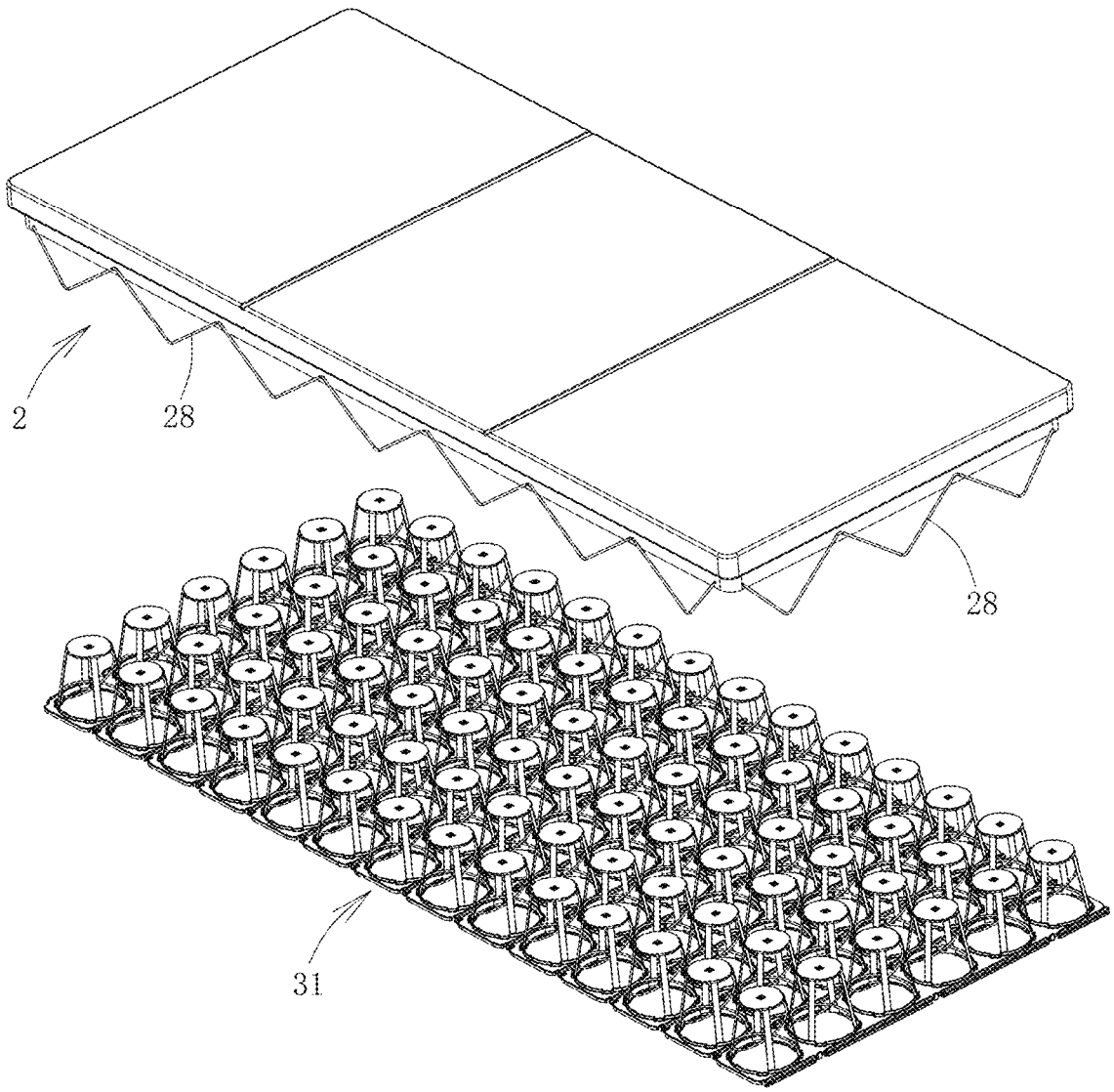
FIG. 8 is a perspective view showing that the pad layer of FIG. 7 laid on the elastic support layer of FIG. 6.
Figure 9:
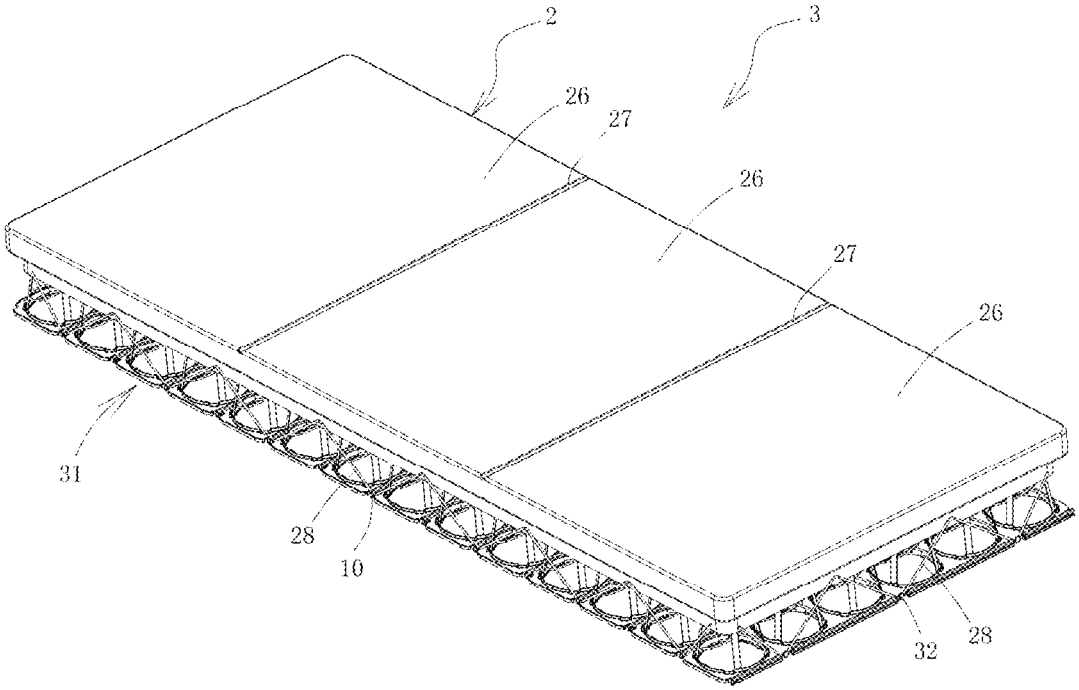
FIG. 9 is a perspective view showing a first type of elastic cushion formed by assembling the pad layer of FIG. 8 on the elastic support layer.
Figure 10:
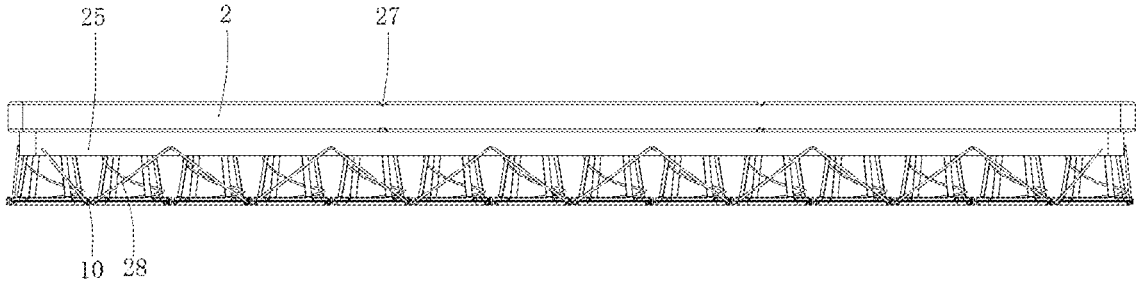
FIG. 10 is a side view of the elastic cushion of FIG. 9 as viewed from a lengthwise side.
Figure 11:
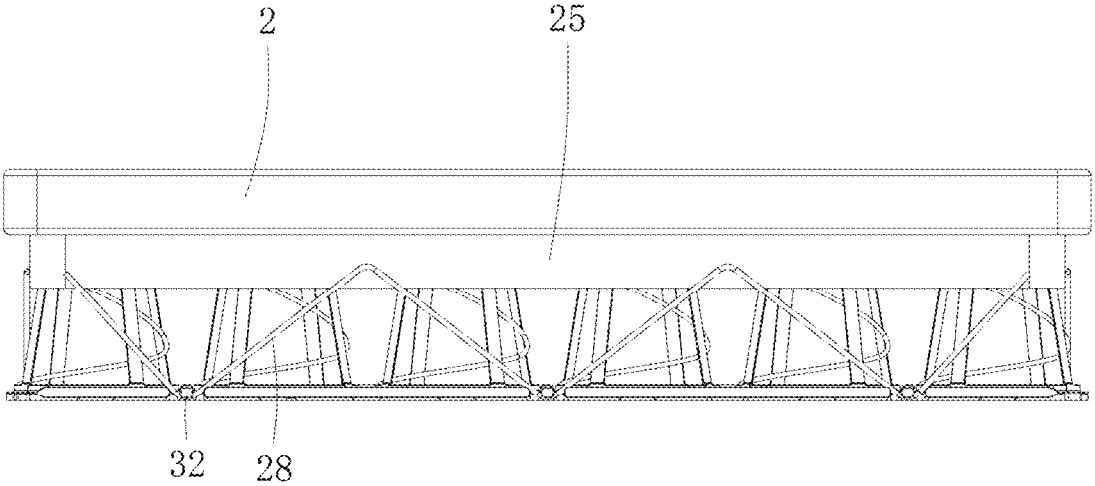
FIG. 11 is a side view of the elastic cushion of FIG. 9 as viewed from a widthwise side.

In addition, in some embodiments, referring to FIG. 1 and FIG. 12, the first connecting structures 7 is disposed at both ends of the splicing side edge 6, wherein an outer end of each first connecting structure 7 is provided with the second connecting structures 8. For example, in FIG. 1, the second connecting structure 8 is disposed at the outermost end of the first connecting structure 7 at the end of the splicing side edge 6. Thus, referring to FIG. 6 and FIG. 15, when a plurality of elastic module units 1 are spliced to form the elastic support layer 31, a plurality of spaced-apart second connecting structures 8 are formed at one side edge of the elastic support layer 31 (e.g., a lengthwise side edge of the elastic support layer 31 in FIG. 6 and FIG. 15), thereby making full use of the outermost end of the first connecting structure 7.

In addition, the second connecting structure 8 at the outermost end of the first connecting structure 7 may be of various types. No matter which type is employed, the second connecting structure 8 is located at the outermost end of the first connecting structure 7 and releasably connected with the edge fastening device 9. For example, in one type, the second connecting structure 8 may be a hook extending from an end face of the outermost end of the first connecting structure 7, so that a connecting rope or a net body of the edge fastening device 9 may be hooked directly on the hook. Alternatively, referring to FIG. 1, in another type, the second connecting structure 8 comprises a hooking groove 10 formed on a bottom side of the outer end of the first connecting structure 7, for example, a recess may be cut directly on the bottom side of the outer end of the first connecting structure 7 as the hooking groove 10, so that the connecting rope or net body of the edge fastening device 9 may be directly hooked in the hooking groove 10.

In addition, in some embodiments, referring to a third type of elastic module unit 1 shown in FIG. 20 through FIG. 26, the first coupling structures 7 on the opposed splicing side edges 6 have the same configuration so that the first coupling structures of the fixed base plates of the plurality of elastic module units 1 may be engaged with a splicing rail 11 such that the plurality of elastic module units 1 are spliced together. Thus, since the first coupling structures 7 on the opposed splicing side edges 6 have the same configuration, the forming efficiency of the elastic module units 1 may be effectively improved. In addition, when spliced, the taking order and splicing orientation of each elastic module unit 1 may not be considered, and the only thing to do is to take any elastic module unit 1 for splicing. In addition, when the plurality of elastic module units 1 are spliced, they are spliced with a splicing rail 11 to form the elastic support layer 31.

Certainly, in some embodiments, the splicing rail 11 may be a separate component that may be purchased separately by a user. Alternatively, in other embodiments, the splicing rail 11 serves as an accessory of the elastic module unit 1. For example, the elastic module unit 1 further comprises a splicing rail 11 configured to be engageable with the first connecting structure 7, and the fixed base plates of the elastic module units 1 disposed side by side are spliced together by means of the engagement of the first connecting structures 7 and the splicing rail 11 to form the elastic support layer 31.

Figure 21:
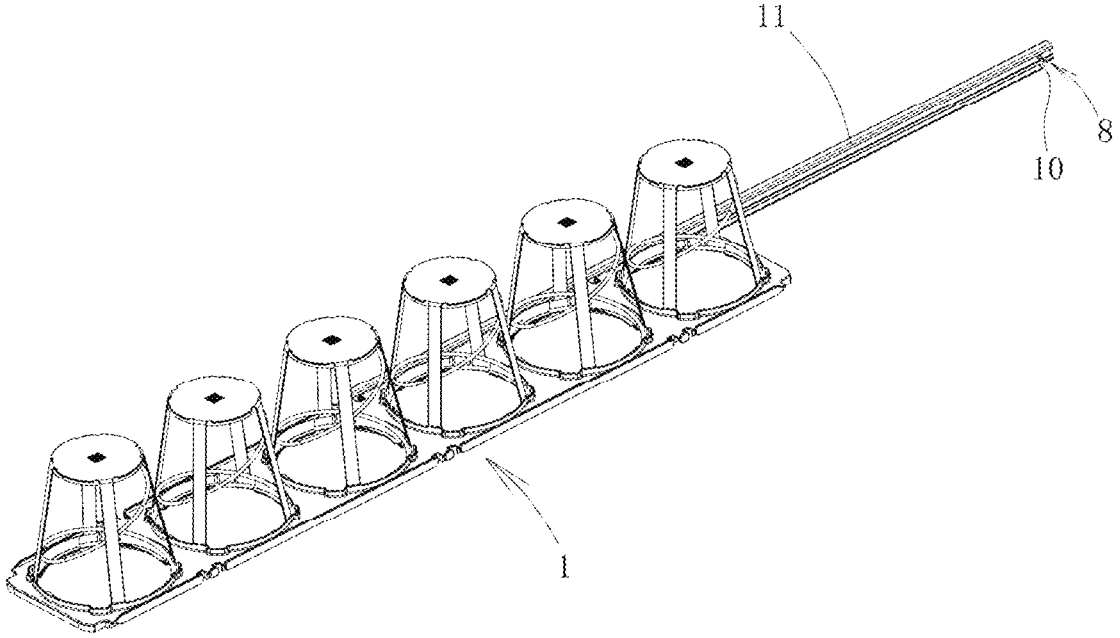
FIG. 21 is a perspective view showing the elastic module unit of FIG. 20 is spliced with a splicing rail.
Figure 22:
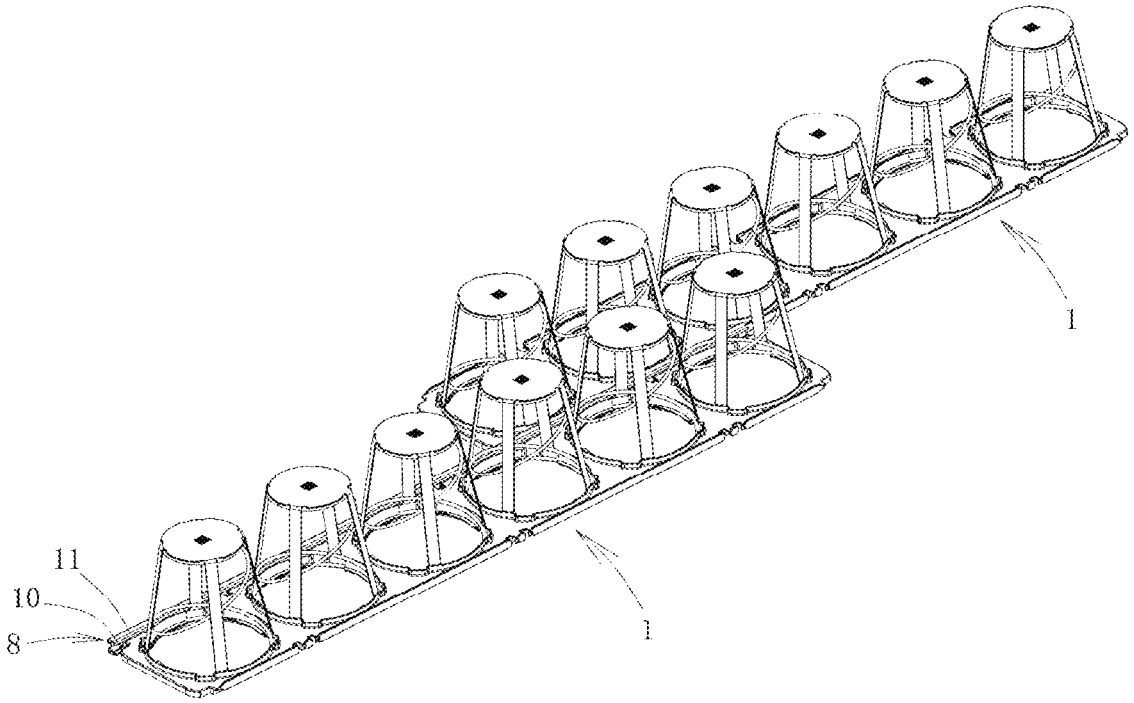
FIG. 22 is a perspective view showing another elastic module unit of FIG. 20 spliced with the splicing rail shown in FIG. 21.
Figure 23:
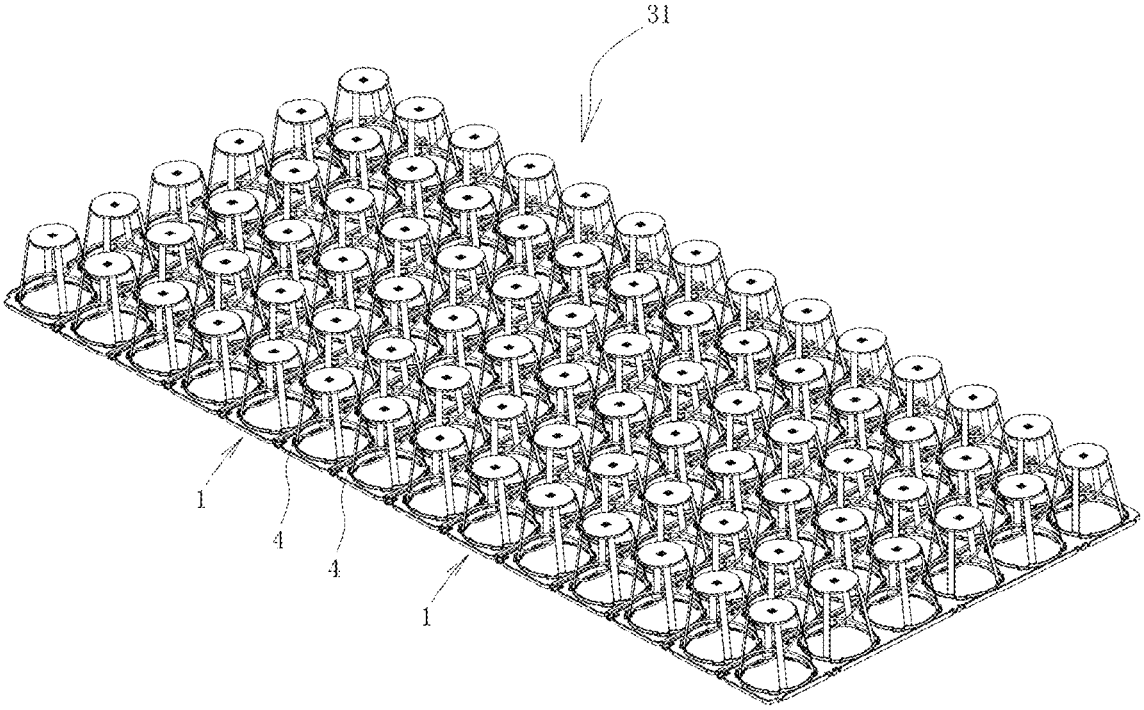
FIG. 23 is a perspective view showing an elastic support layer formed by splicing a plurality of elastic module units of FIG. 20 through a splicing rail in the splicing manner shown in FIGS. 21 and 22.
Figure 24:
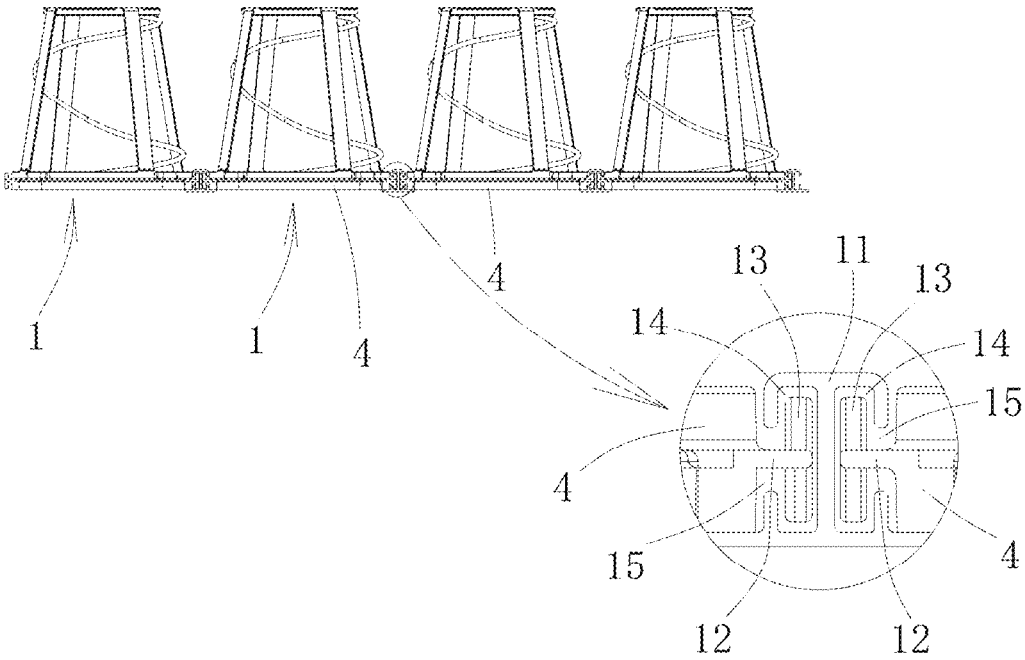
FIG. 24 is a schematic view of a portion of the structure of the elastic support layer of FIG. 23, showing one partially enlarged structure.
Figure 25:
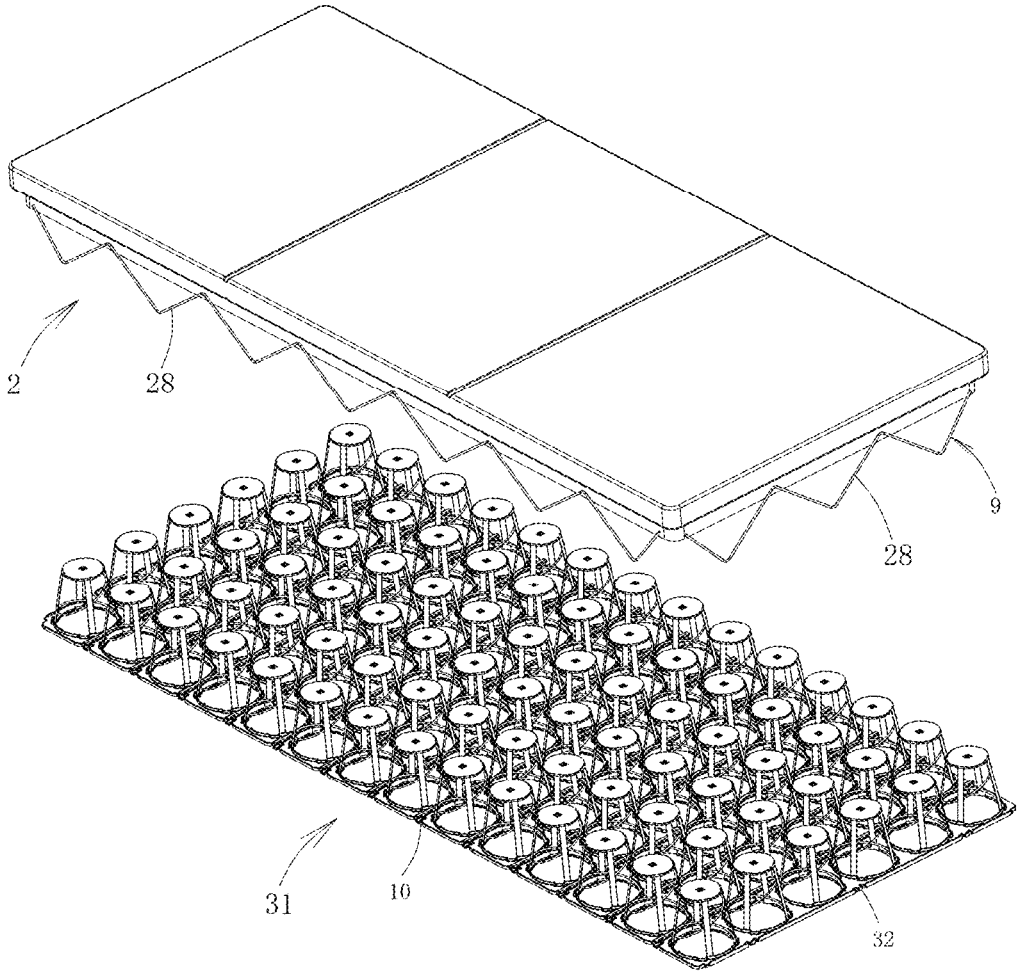
FIG. 25 is a perspective view showing a pad layer of a third type of elastic cushion of the present disclosure is laid on the elastic support layer of FIG. 23.
Figure 26:
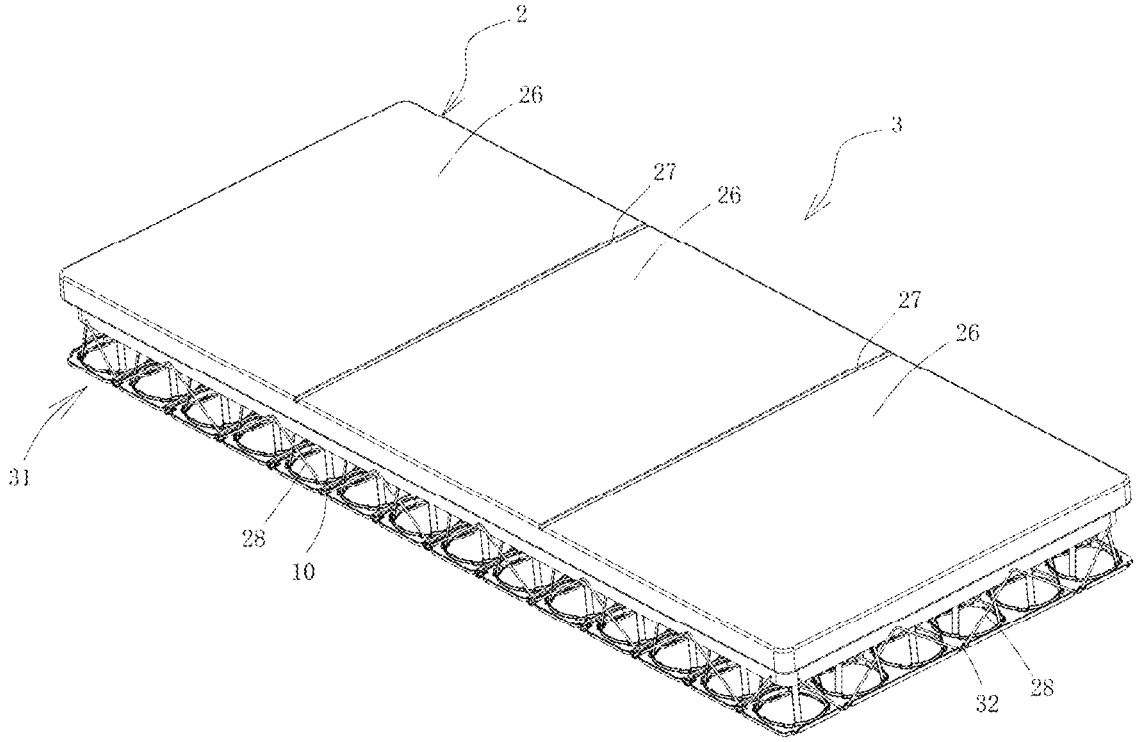
FIG. 26 is a perspective view of a third type of elastic cushion formed by assembling the pad layer of FIG. 25 on the elastic support layer.

When a plurality of elastic module units 1 in the third type are spliced, referring to FIG. 21, one side of a first splicing rail 11 may be spliced with the first connecting structures 7 of the splicing side edge 6 of one side of the first elastic module unit 1, and then referring to FIG. 22, the first connecting structures 7 of the splicing side edge 6 of one side of a second elastic module unit 1 are spliced with the other side of the first splicing rail 11, so that two elastic module units 1 may be spliced together via one splicing rail 11 to form a first group of elastic module units; one side of a second splicing rail 11 is spliced to the splicing side edge 6 of the other side of the first group of elastic module units 1, and then a third elastic module unit 1 is spliced to the other side of the second splicing rail 11, so on so forth, to form the elastic support layer 31, e.g., the elastic support layer 31 shown in FIG. 23.

In the third types of elastic module units 1, in some embodiments, for example, the elastic module unit 1 shown in FIG. 20 may be formed with the second connecting structure 8 on the widthwise side, so that a plurality of second connecting structures 8 may be formed on the lengthwise side of the elastic support layer 1 shown in FIG. 23 to facilitate the connection of the edge fastening device 9. In some other embodiments, since the plurality of elastic module units 1 are spliced together via the splicing rail 11, both ends of the rail 11 may be sufficiently used. With reference to FIG. 21 and FIG. 22, both ends of the splicing rail 11 are respectively formed with the second connecting structure 8, for example, a hooking groove 10 may be respectively cut out directly at the bottom sides of both ends of the splicing rail 11 to serve as the second connecting structure 8, or a hook may be respectively mounted directly at both ends of the splicing rail 11 to serve as the second connecting structure 8. As such, a plurality of second attachment structures 8 may be formed on the lengthwise side of the elastic support layer 1 shown in FIG. 23 to facilitate connection with the edge fastening device 9.

In addition, in the third type of elastic module units 1, the first connecting structure 7 and the splicing rail 11 may be of various types. No matter which type is employed, the first connecting structure 7 can engage the splicing rail 11. For example, in one type, referring to FIG. 24, the first connecting structure 7 comprises a first horizontal side edge 12 extending outward from the fixed base plate 4 and a vertical snap tab 13 connected to a suspended end of the first horizontal side edge 12, two opposite longitudinal sides of the splicing rail 11 are respectively formed with snap sliding grooves 14 having groove openings 15, and the snap sliding grooves 14 are configured to enable adjacent first horizontal side edges 12 to enter through the groove openings 15 and engage with adjacent vertical snap tabs 13, such that two elastic module units 1 are spliced together by one splicing rail 11.

In addition, in some embodiments, referring to the first type of elastic module units 1 shown in FIG. 1, the second type of elastic module units 1 shown in FIG. 12, and the fourth type of elastic module units 1 shown in FIG. 27, the first connecting structures 7 formed on the opposed splicing side edges 6 have configurations which are shaped differently but can cooperate with each other, so that the fixed base plates of adjacent elastic module units 1 in the plurality of elastic module units 1 can be directly spliced together by means of the engagement of the first connecting structures 7 with each other. As such, as compared with the third type of elastic module units 1, the plurality of elastic module units 1 may be directly spliced without resorting to the splicing rail 11.

Figure 4:
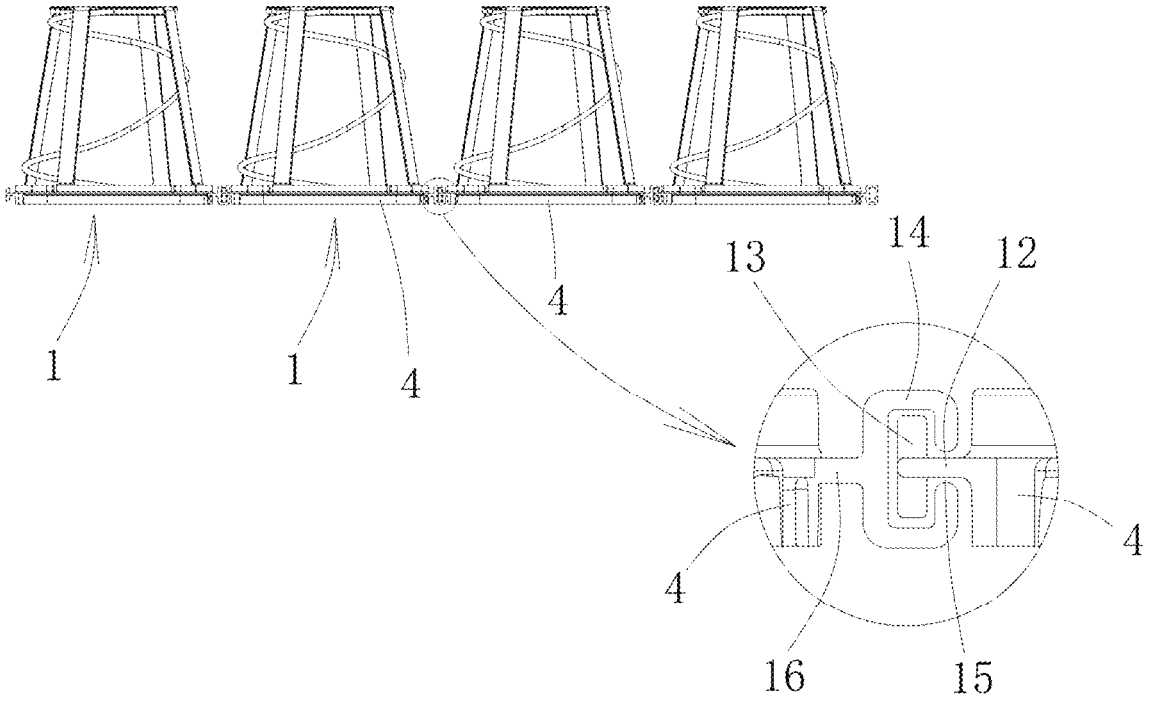
FIG. 4 is a side view of a plurality of the elastic module units of FIG. 1 spliced together, wherein one partially enlarged structure is shown.
Figure 5:
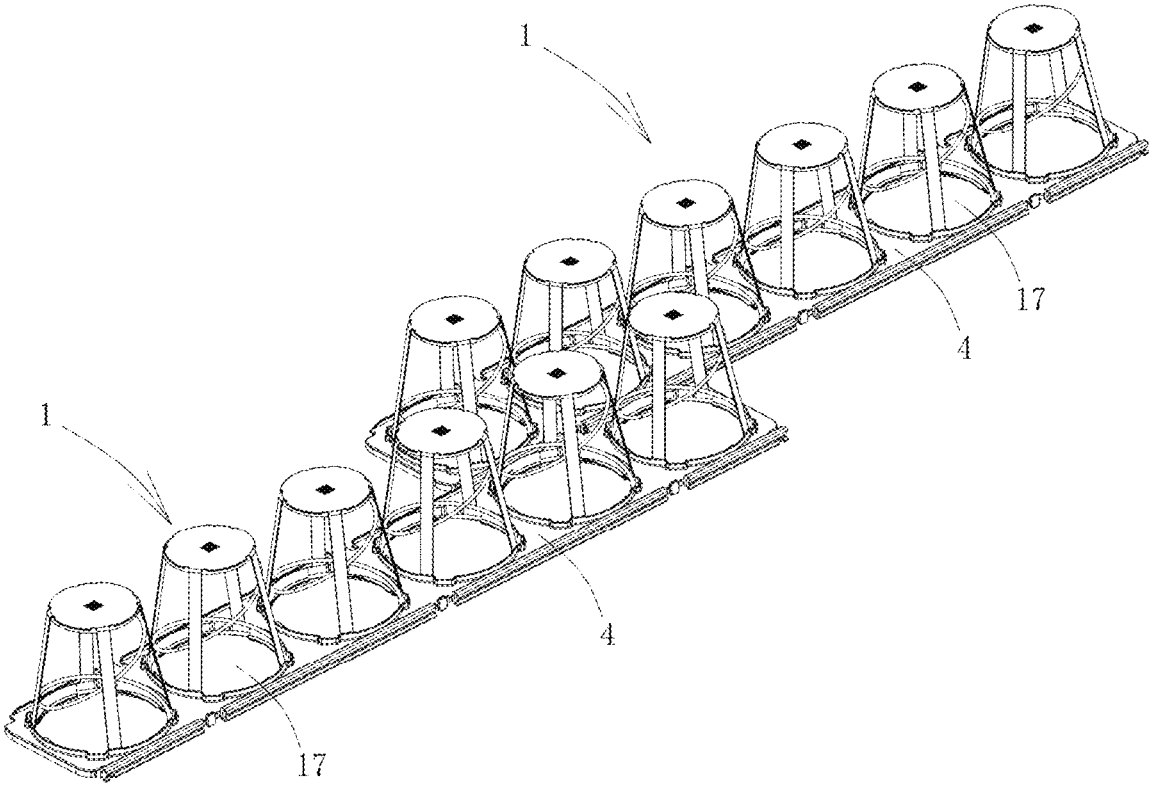
FIG. 5 is a perspective view showing a plurality of elastic module units of FIG. 1 spliced together.
Figure 33:
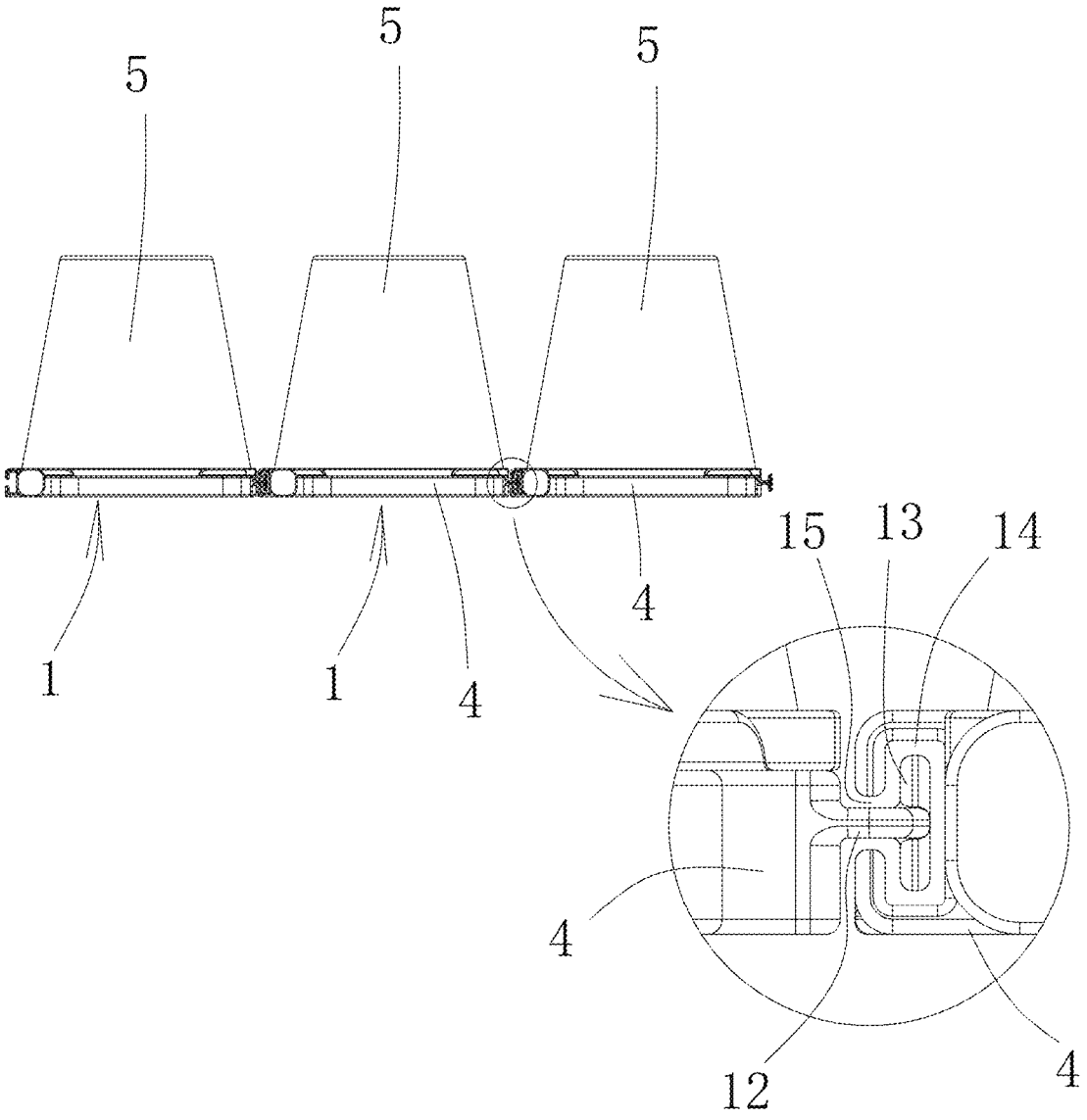
FIG. 33 is a schematic view of a portion of the structure of the elastic support layer of FIG. 32, showing one partially enlarged structure.

In addition, referring to the first type of elastic module units 1 shown in FIG. 1, the second type of elastic module units 1 shown in FIG. 12, and the fourth type of elastic module units 1 shown in FIG. 27, the first coupling structure 7 may be in various types. No matter which type is employed, the first coupling structures 7 of the opposite splicing side edges 6 may be engaged with each other. For example, with reference to FIG. 3 and FIG. 4 as well as FIG. 28 and FIG. 33, the first connecting structure 7 of the splicing side edge 6 located on one side comprises a first horizontal side edge 12 extending outwards from the fixed base plate 4 and a vertical snap tab 13 connected to the suspended end of the first horizontal side edge 12, and the first connecting structure 7 of the splicing side edge 6 located on the other side comprises a snap sliding groove 14 having a groove opening 15, so that the first horizontal side edge 12 of one elastic module unit 1 of the plurality of elastic module units 1 extends through the groove opening 15 of another adjacent elastic module unit 1 into the snap sliding groove 14, leading to engagement of the vertical snap tab 13 of one elastic module unit 1 is in the snap sliding groove 14 of another adjacent elastic module unit 1. As such, referring to FIG. 4 and FIG. 33, the vertical snap tab 13 of one elastic module unit 1 slides from an end opening of the snap sliding groove 14 into the snap sliding groove 14, and the first horizontal side edge 12 passes through the groove opening 15, so that the two elastic module units 1 may be directly spliced together.

Figure 28:
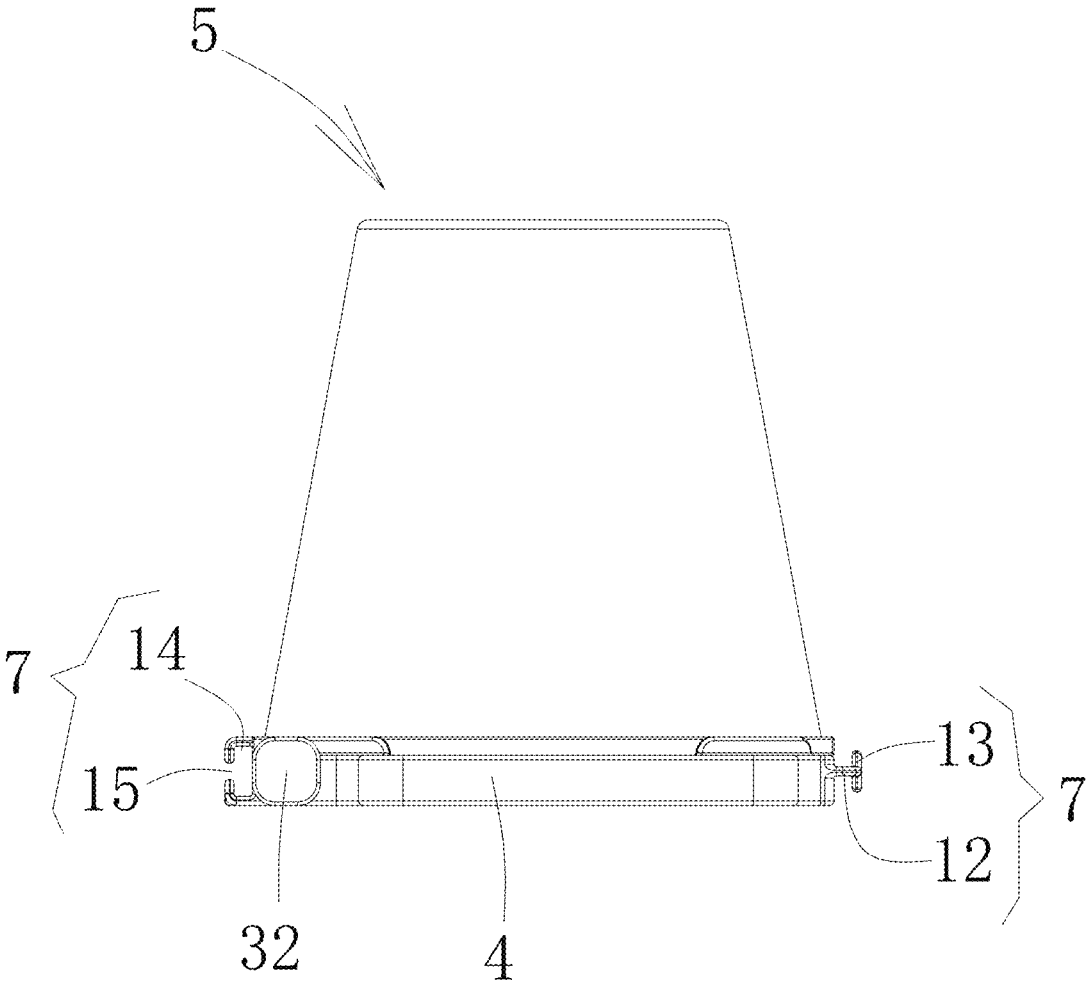
FIG. 28 is a side view of the elastic module unit of FIG. 27.

In addition, referring to FIG. 28, a groove bottom wall of the snap sliding groove 14 may be directly connected to the fixed base plate 4, or part of the fixed base plate 4 serves as the groove bottom wall of the snap sliding groove 14. In addition, referring to FIG. 3, the groove bottom wall of the snap sliding groove 14 is connected to the fixed bottom plate 4 by a second horizontal side edge 16.

In addition, in the elastic module unit 1 shown in FIG. 1 and FIG. 12, since the second connecting structure 8 is disposed at the outermost end of the first connecting structure 7 at the end of the splicing side edge 6, the second connecting structure 8 may not be provided at a short side of the fixed base plate 4. In the elastic module unit 1 shown in FIG. 27, since the second connecting structure 8 is not disposed at the outermost end of the first connecting structure 7 at the end of the splicing side edge 6, at least one second connecting structure 8 is formed at the short side of the fixed base plate 4, for example, the hanging snap 32 shown in FIG. 27. The hanging snap 32 may be a horizontally disposed T-shaped snap, or may be a downwardly curved snap.

In addition, in some embodiments, the fixed base plate 4 may be a complete plate member, i.e., the fixed base plate 4 is not formed with any type of mounting opening. In this way, when the plurality of elastic module units 1 are stored, it is only necessary to place the fixed base plate 4 of an upper elastic module unit 1 on the plurality of elastic modules 5 of a lower elastic module unit 1. Furthermore, in other embodiments, with reference to FIG. 1 and FIG. 2, FIG. 12 and FIG. 13, and FIG. 20 and FG. 29, the fixed base plate 4 is formed with a plurality of mounting openings 17 arranged at an interval, each of the plurality of elastic modules 5 is mounted on a corresponding one of the mounting openings 17, and an internal cavity 18 of the elastic module 5 is in communication with the corresponding mounting opening 17, so that the plurality of elastic module units 1 can be successively nested and stacked via a manner of passing each elastic module 5 of one elastic module unit 1 through the corresponding mounting opening 17 of another elastic module unit 1 into the internal cavity 18. Thus, the plurality of elastic module units 1 may be sequentially nested and stacked, thereby further reducing the storage space and facilitating the transportation of the plurality of elastic module units.

Figure 29:
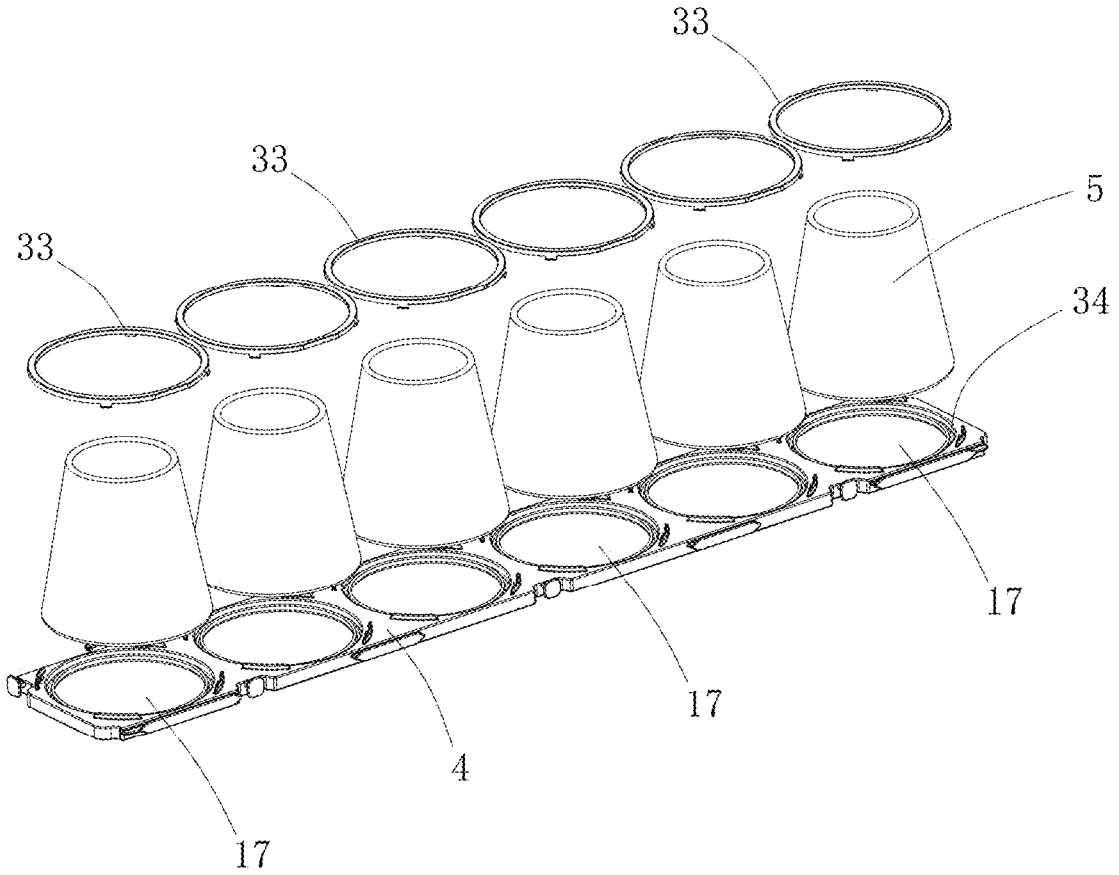
FIG. 29 is an exploded view of the elastic module units of FIG. 27.
Figure 30:
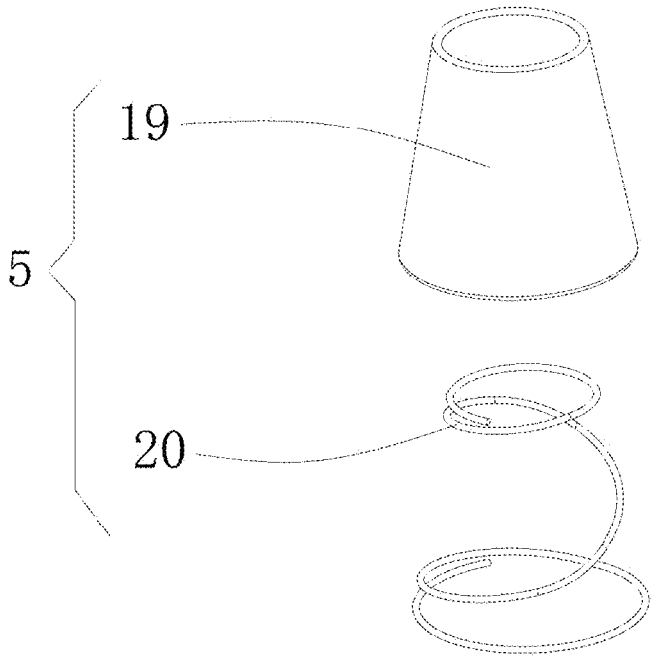
FIG. 30 is an exploded view of an elastic module of the elastic module unit of FIG. 29.
Figure 31:
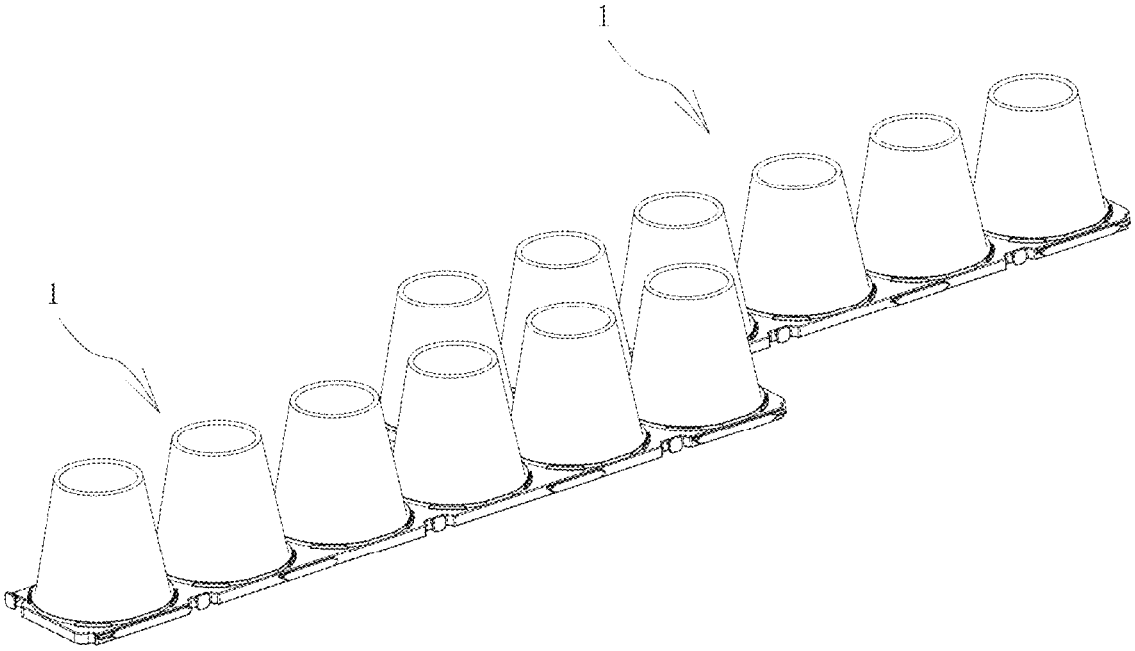
FIG. 31 is a side view showing a plurality of the elastic module units of FIG. 27 are spliced together.
Figure 32:
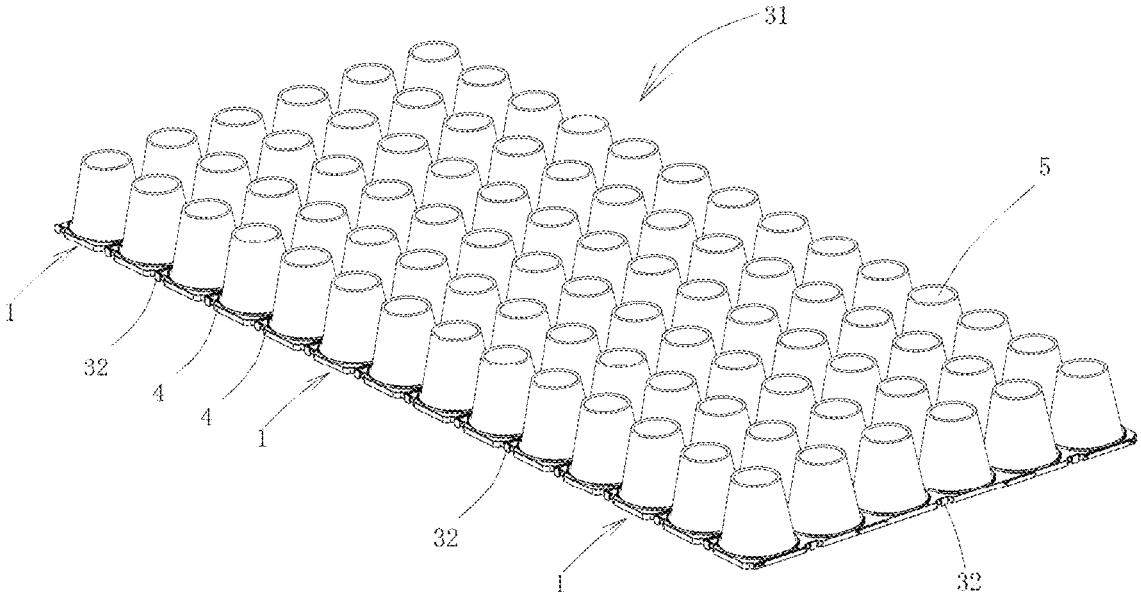
FIG. 32 is a perspective view of an elastic support layer formed by splicing a plurality of elastic module units of FIG. 27 in the splicing manner shown in FIG. 31.

Further, the elastic module 5 of the elastic module unit 1 may be in various types, for example, in one type of the elastic module 5, the elastic module 5 may be a rubber cylinder such as a rubber frustum. Alternatively, in another type of the elastic module 5, referring to FIG. 29 and FIG. 30, the elastic module 5 comprises a spring 20 and a frame 21 having the internal cavity 18, wherein the frame 21 comprises a top cover 23, a bottom ring connected to the fixed base plate 4, and a plurality of connection strips 24 arranged spaced apart along a circumference of the frame 21 and extending between the top cover and the bottom ring. The spring 20 is provided in the frame 21 in a pre-compressed state. Thus, the elastic module with a pocket spring structure is formed.

One end of a cloth pocket 19 may be welded, sewn or pressed to the fixed base plate 4. For example, referring to FIG. 29, the fixed base plate 4 is formed with a pressing groove 34 around the mounting opening 17, one end of the cloth pocket 19 may be disposed in the pressing groove 34, and then a pressing ring 33 is disposed on the fixed base plate 4 and presses one end of the cloth pocket 19, thereby pressing the one end of the cloth pocket against the fixed base plate 4. In addition, a lower end rim of the spring 20 may be located in the pressing groove 34, which further enhances the reliability of the positioning of the spring 20.

In addition, in some embodiments, the cloth pocket 19 may be a single-layer cloth pocket, an upper end of the single-layer cloth pocket is provided with a spring positioning ring, an upper end of the spring abuts against the spring positioning ring, and the spring positioning ring has a predetermined strength to hold and position the spring. In an optional embodiment, the cloth pocket 19 may comprise an inner sleeve and an outer sleeve, upper ends of the inner sleeve and the outer sleeve are connected, and the spring 20 is positioned between the inner sleeve and the outer sleeve.

In other types of the spring modules 5, referring to FIG. 1, FIG. 12 and FIG. 20, the spring module 5 comprises a spring 20 and a frame 21 having an internal cavity 18, wherein the frame 21 comprises a top cover 23, a bottom ring connected to the fixed base plate 4, and a plurality of connecting strips 24 arranged spaced apart along the periphery of the frame 21 and extending between the top cover and the bottom ring. The spring 20 is disposed in the frame 21 in a pre-compressed state, such that the spring module with a frame spring structure is formed.

Figure 18:
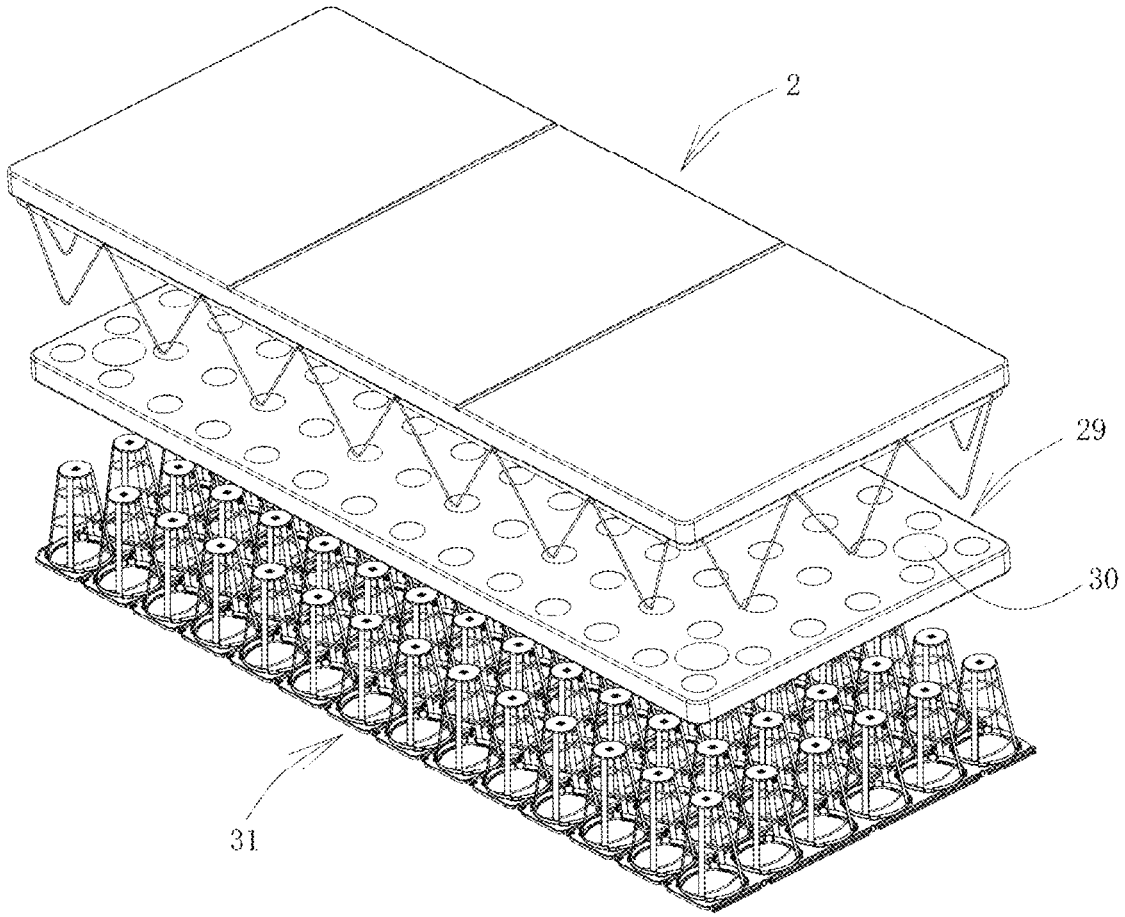
FIG. 18 is a perspective view showing the pad layer of FIG. 17 is laid on the balancing pad of FIG. 16.
Figure 19:
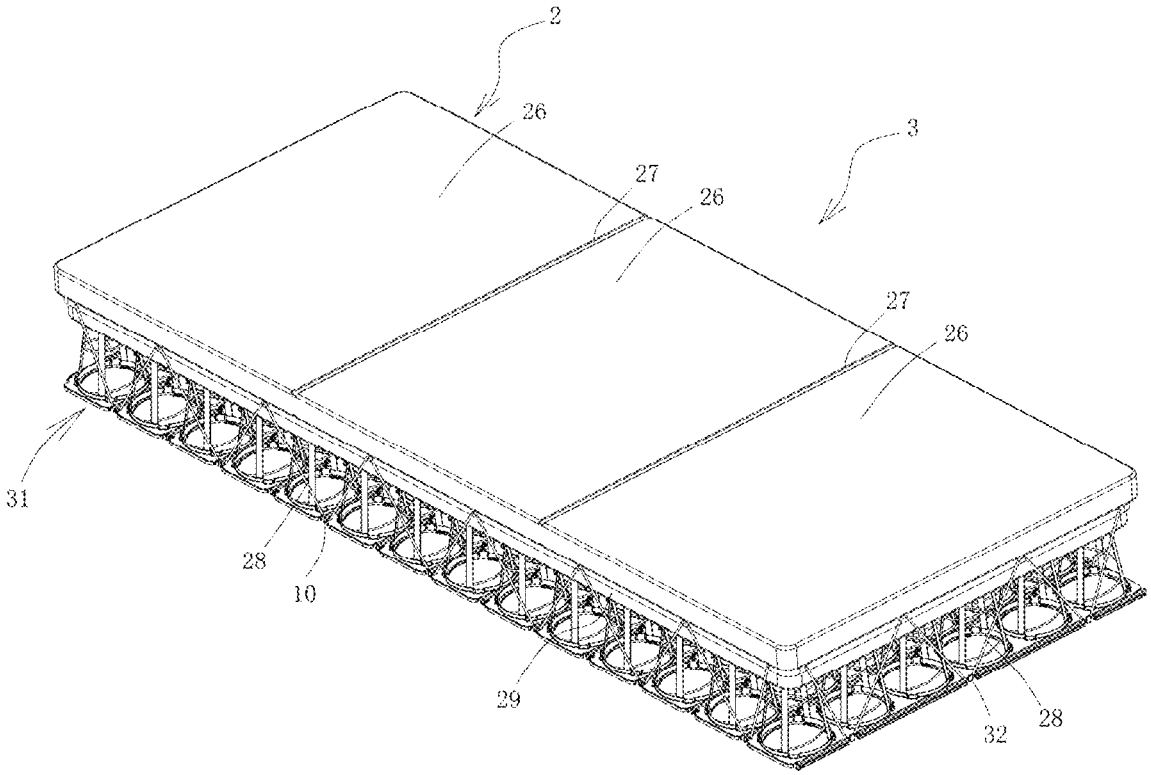
FIG. 19 is a perspective view of a second type of elastic cushion formed by assembling the pad layer of FIG. 18 on the balancing pad and the elastic support layer.
Figure 34:
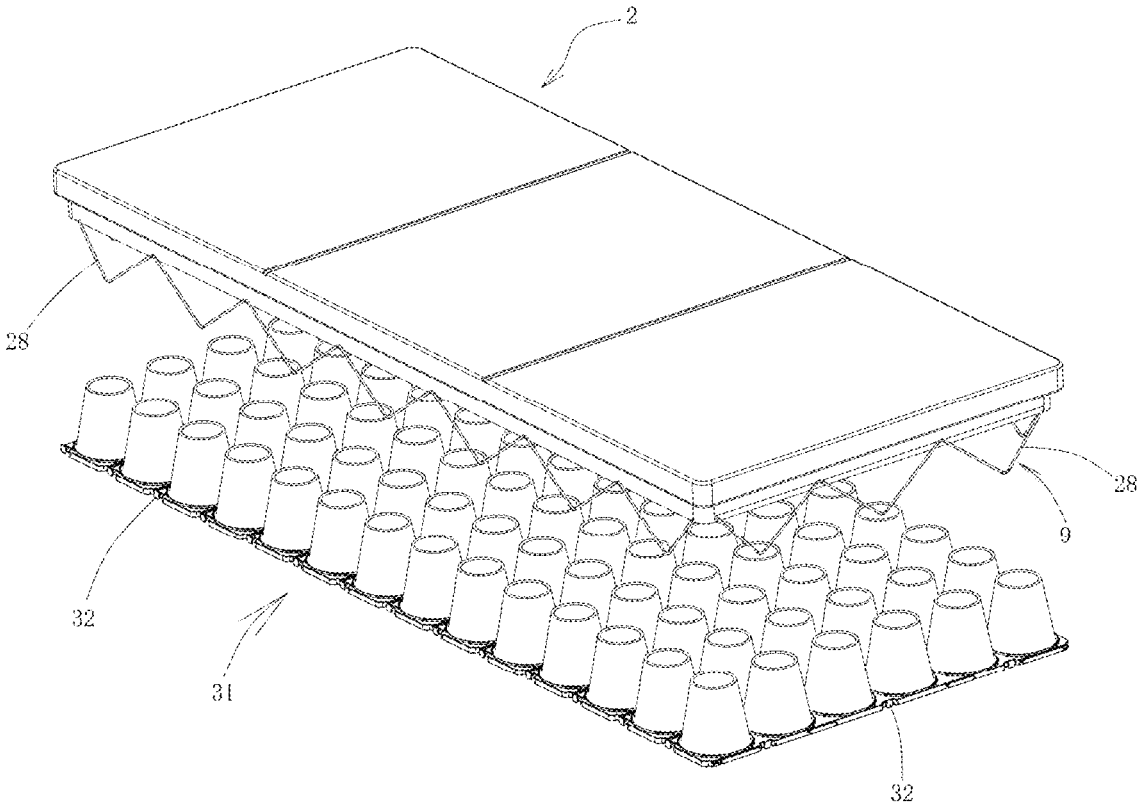
FIG. 34 is a perspective view illustrating a pad layer of a fourth type of elastic cushion according to the present disclosure is laid on the elastic support layer of FIG. 32.
Figure 35:
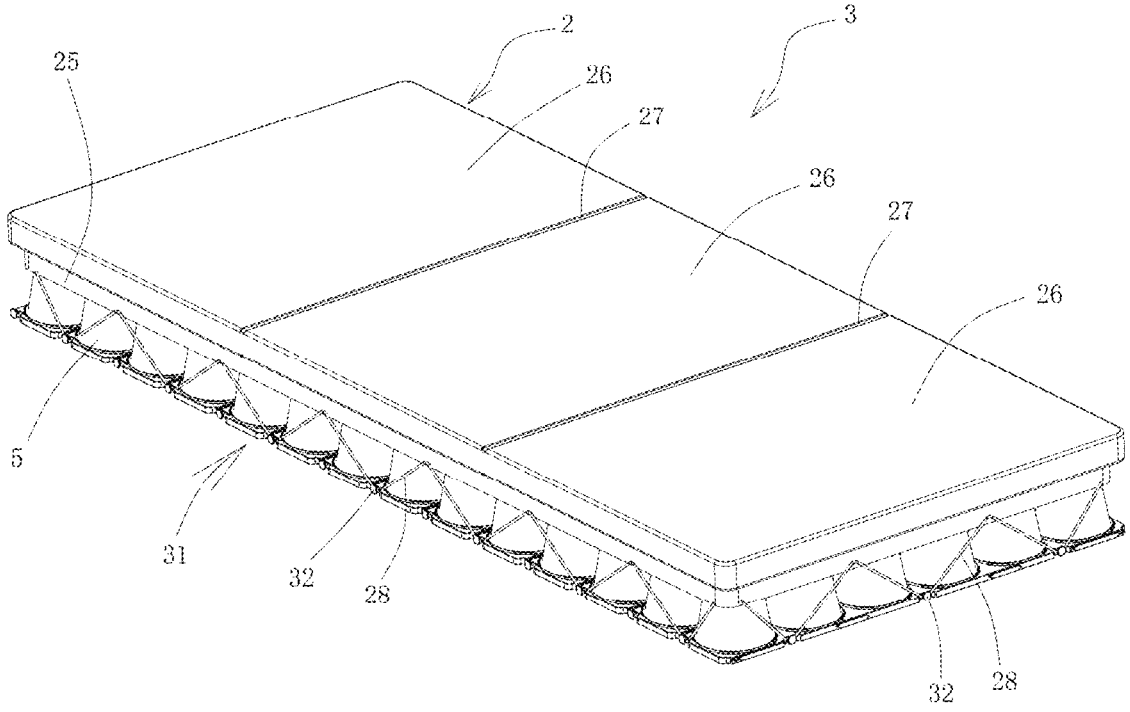
FIG. 35 is a perspective view of the fourth type of elastic cushion formed by assembling the pad layer of FIG. 34 on the elastic support layer.

In a second aspect, the present disclosure provides an elastic cushion 3. Referring to the first type of elastic cushion 3 shown in FIG. 8-FIG. 11, the second type of elastic cushion 3 shown in FIG. 18 and FIG. 19, the third type of elastic cushion 3 shown in FIG. 25 and FIG. 26, and the fourth type of elastic cushion 3 shown in FIG. 34 and FIG. 35, the elastic cushion 3 of the present disclosure comprises a pad layer 2 and a plurality of elastic module units 1 according to any one of the first aspect described above, the fixed base plates 4 of the plurality of elastic module units 1 are spliced together with the first connecting structures 7 to assemble into the elastic support layer 31; the pad layer 2 is laid on the plurality of elastic modules 5 of the elastic support layer 31; wherein the second connecting structures 8 and an outer edge of the pad layer 2 are connected by the edge fastening device 9 such that the elastic cushion 3 can be formed as an elastic cushion with fully opened sides, i.e. without a sealing side enclosure.

As described above, the fixed base plates 4 of adjacent elastic module units 1 can be spliced together via the first connecting structure 7. In this way, the plurality of elastic module units 1 can be successively spliced and assembled into the elastic support layer 31, thereby achieving a quick and convenient assembly of the elastic support layer 31. After the pad layer 2 is laid on the elastic support layer 31, the second connecting structure 8 and the pad layer 2 are connected via the edge fastening device 9, thereby fixing the pad layer 2 on the elastic support layer 31 and form the elastic cushion 3 with fully opened sides. Since there is no sealed side enclosure provided, the elastic cushion has a transparent inner structure which make the cushion to have a good ventilation, thereby enhancing the ventilation and comfort of the elastic cushion 3. When the elastic cushion 3 needs to be collected and stored, the edge fastening devices 9 and the second connecting structures 8 are released, and the fixed base plates 4 are disengaged from each other, so that the elastic cushion can be quickly and conveniently disassembled for storage. This can effectively facilitate the transportation of the elastic cushion and can reduce the storage space of the elastic cushion.

In addition, in some embodiments, in order to improve the stability of the plurality of elastic modules 5 of the elastic support layer 31 and improve the comfort of the elastic cushion, referring to FIG. 7-FIG. 11, FIG. 17-FIG. 19, FIG. 25 and FIG. 26, and FIG. 34 and FIG. 35, the pad layer 2 comprises a stop ring 25 extending from a lower surface of the pad layer towards the elastic modules 5, the stop ring 25 blocks the outermost elastic module 5, and the stop ring 25 is connected with the second connecting structure 8 via the edge fastening device 9. In this way, under the tension action of the edge fastening device 9, the stop ring 25 may be brought into a downwardly-extending tensioned state, thereby abutting against the outermost elastic module 5, effectively preventing movement of the outermost elastic module 5 in the transverse direction of the elastic cushion, and improving the stability of the elastic module.

In addition, to facilitate storage of the elastic cushion, in some embodiments, referring to FIG. 7-FIG. 11, FIG. 17-FIG. 19, FIG. 25 and FIG. 26, and FIG. 34 and FIG. 35, the pad layer 2 is a material layer that may be folded or rolled up. For example, the pad layer 2 may be an elastic sponge layer. In this way, the pad layer 2 may be folded or rolled up, thereby reducing storage space and facilitating the transportation.

In addition, in some embodiments, with reference to FIG. 7-FIG. 11, FIG. 17-FIG. 19, FIG. 25 and FIG. 26, and FIG. 34 and FIG. 35, the pad layer 2 comprises a plurality of elastic pad blocks 26 arranged in a lengthwise direction of the elastic cushion, the adjacent elastic pad blocks 26 are connected by a thinned flexible hinge portion. In this way, folding or rolling of the pad layer 2 may be further facilitated by the flexible hinge portion.

Furthermore, the flexible hinge portion may be of various types. For example, in one type of flexible hinge portion, the flexible hinge portion may be a connecting cloth layer, such as a nonwoven fabric layer or a canvas layer. In another type of flexible hinge portion, referring to FIG. 7-FIG. 11, FIG. 17-FIG. 19, FIG. 25 and FIG. 26, and FIG. 34 and FIG. 35, the flexible hinge portion comprises a groove 27 formed on a pad layer upper surface and/or a pad layer lower surface of the pad layer 2 and extending in the widthwise direction of the elastic cushion, so that the pad layer 2 may be a one-piece pad layer, and the only thing to do is to process to produce the groove 27 in the widthwise direction.

In addition, the edge fastening device 9 may have various structures. No matter what structure is employed, the elastic support layer 31 and the pad layer 2 can be connected so that the elastic cushion do not have the sealing side enclosure. For example, in a structure of the edge fastening device 9, the edge fastening device 9 may be a net body, so that the air permeability of the elastic cushion 3 may be improved by a plurality of meshes of the net body. In another construction of the edge fastening device 9, referring to FIG. 7-FIG. 11, FIG. 17-FIG. 19, FIG. 25 and FIG. 26, and FIG. 34 and FIG. 35, the edge fastening device 9 comprises a releasably connectable connecting rope 28, e.g., the connecting rope 28 may be connected at the edge of the pad layer 2, e.g., the connecting rope 28 is connected on the stop ring 25. Thus, the connecting rope 28 only needs to be hooked to the corresponding second connecting structure 8 such as the hooking groove 10 and the hooking snap 32. In addition, the connecting rope 28 may be a plurality of independent and spaced-apart loops, or may extend continuously in an undulating manner.

Figure 15:
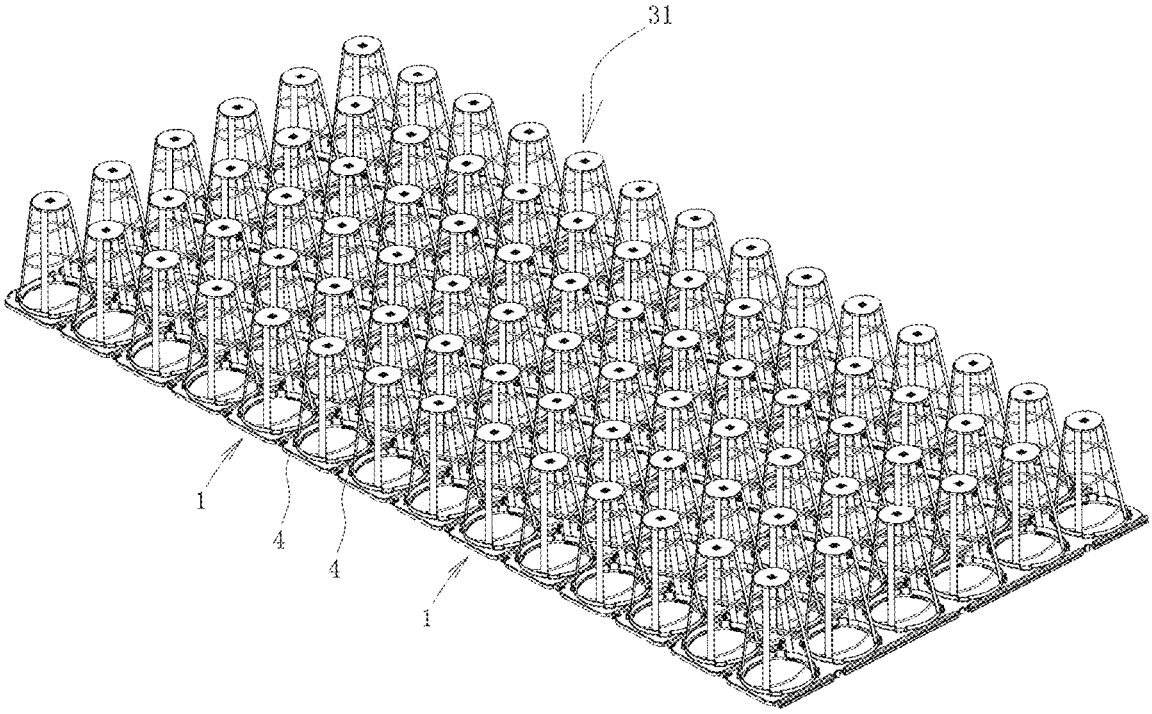
FIG. 15 is a perspective view of an elastic support layer formed by splicing a plurality of elastic module units of FIG. 12 in the splicing manner shown in FIG. 14.
Figure 16:
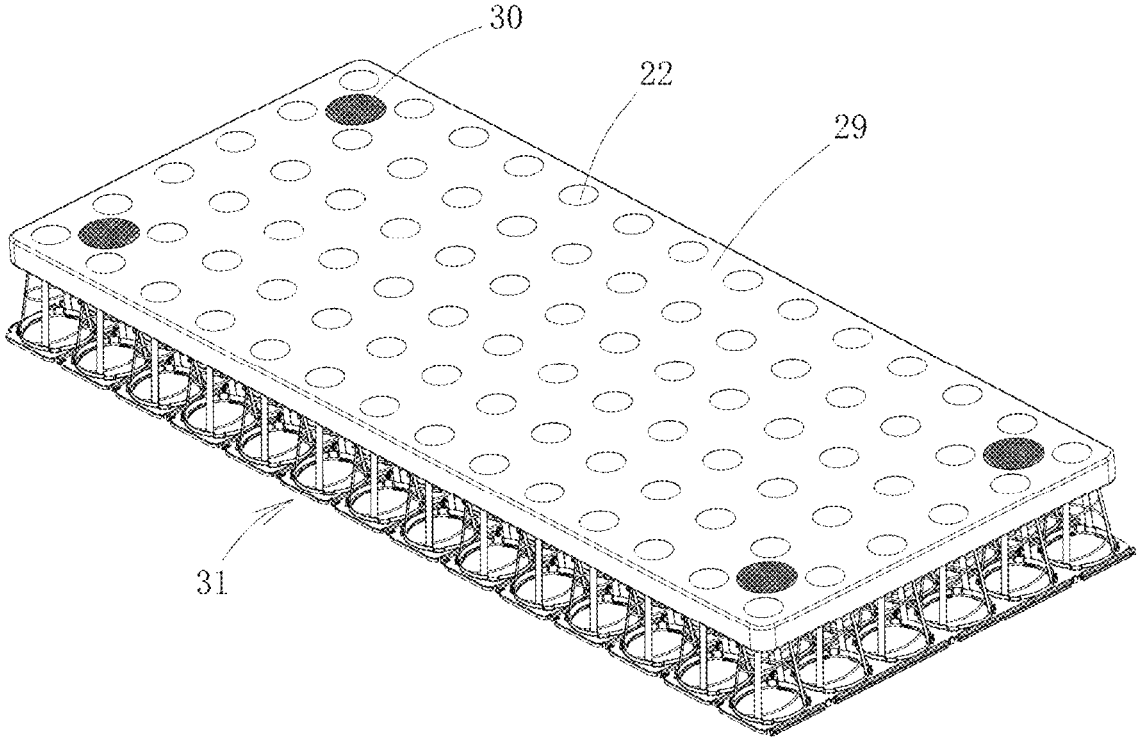
FIG. 16 is a perspective view showing a balancing pad of a second type of elastic cushion of the present disclosure laid on the elastic support layer of FIG. 15.

Furthermore, in some embodiments, with reference to FIG. 15 and FIG. 16, the elastic cushion 3 comprises a balancing pad 29, wherein the balancing pad 29 is laid on the plurality of elastic modules 5 in a height direction of the elastic cushion and can limit the transverse movements of the plurality of elastic modules 5 in the transverse direction of the elastic cushion, and the pad layer 2 is laid on the balancing pad 29 in the height direction. In this way, the balancing pad 29 may effectively limit the transverse movement of the plurality of elastic modules 5 in the transverse direction of the elastic cushion, thereby improving the stability of the elastic support layer 31.

In addition, referring to FIG. 16, a plurality of buffering holes 22 are formed on an upper surface of the balancing pad 29 facing away from the plurality of elastic modules 5, each buffering hole 22 has a hole bottom wall, and each buffering hole 22 is aligned with one elastic module 5. As such, the plurality of buffering holes may form a buffering layer portion on the upper portion of the balancing pad, and the buffering layer portion may significantly improve the buffering performance and comfort performance of the balancing pad by the air contained in the plurality of buffering holes, and the only thing to do is to lay a thin pad layer on the balancing pad. In addition, each of the buffering holes 22 may disperse a supporting force of its corresponding elastic module to the surrounding area of the buffering hole 22 through the hole bottom wall thereof, so that a significant supporting hard point of the elastic module is not felt on the upper surface of the balancing pad 3, thereby further improving comfort.

The balancing pad 29 may limit the transverse movement of the plurality of elastic modules 5 in the transverse direction of the elastic cushion in various manners. For example, in one manner, a plurality of receiving holes are formed on a lower surface of the balancing pad 29 facing the elastic modules 5, and the top of each elastic module 5 may be engaged in each corresponding receiving hole. Preferably, the elastic module 5 has a frusto-conical shape, and correspondingly the receiving hole has a frusto-conical shape. In another manner, a plurality of limiting posts may protrude from the lower surface of the balancing pad 29 facing the elastic modules 5, and the limiting posts may extend into a space between the elastic modules 5 and abut against the outer circumferential surface of each elastic module 5, which may also limit the transverse movement of the plurality of elastic modules 5 in the transverse direction of the elastic cushion.

Figure 17:
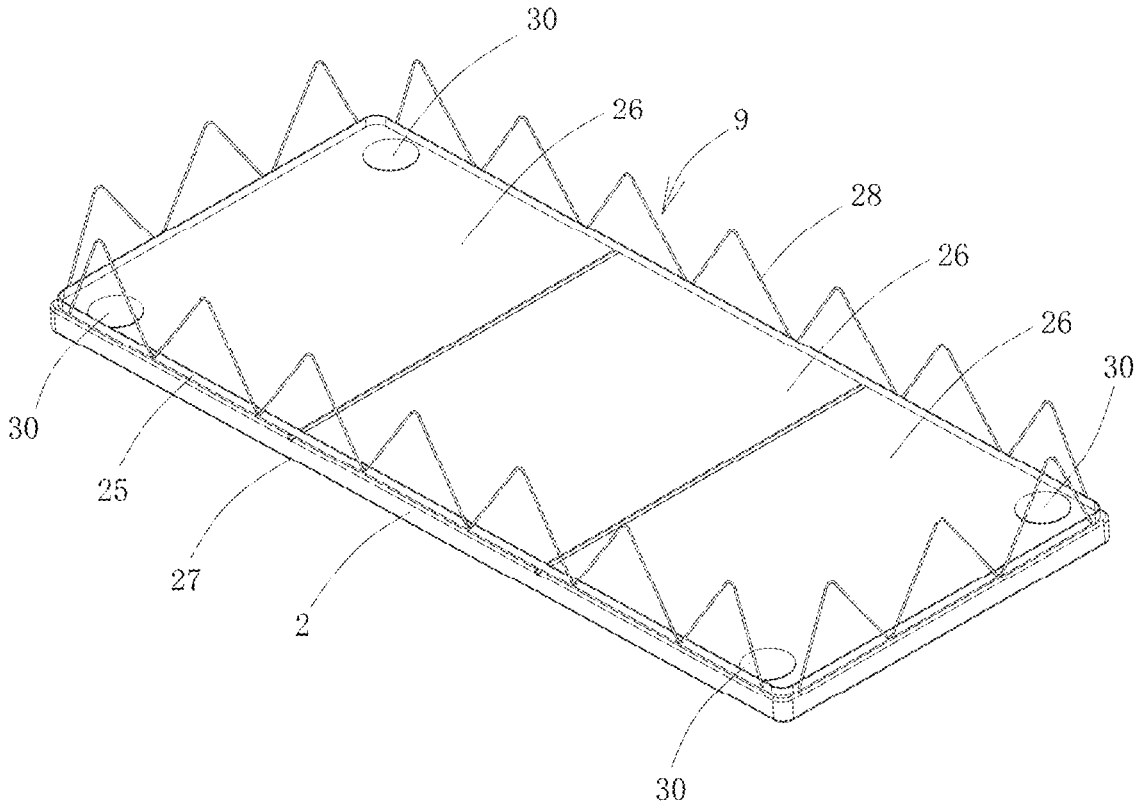
FIG. 17 is a perspective view exemplarily showing a pad layer of the second elastic cushion according to the present disclosure as viewed from bottom.

Furthermore, in some embodiments, with reference to FIG. 16 and FIG. 17, the pad layer 2 and the balancing pad 29 are connected by means of a positioning structure arranged therebetween. As such, it is possible to, by means of the positioning structure, improve the stability between the pad layer 2 and the balancing pad 29, avoid the occurrence of the transverse displacement of the pad layer 2 relative to the balancing pad 29, and also avoid pulling the edge fastening device 9 when the pad layer 2 displaces transversely. In addition, since the pad layer 2 and the balancing pad 29 are connected by the positioning structure to limit the transverse displacement, the balancing pad 29 cooperates with a plurality of elastic modules to limit the transverse displacement, and meanwhile, the pad layer 2 and the elastic support layer 31 are connected by the edge fastening device 9 to limit the transverse displacement. As such, the integrity, stability and comfort of the elastic cushion 3 may be further improved by the limitation of transverse displacement in the above three aspects.

In addition, the positioning structure may be of various types. For example, in one type, the positioning structure may be a projection and a groove which mate with each other. The projection is formed on one of the pad layer 2 and the balancing pad 29 and the recesses is formed on the other of the pad layer 2 and the balancing pad 29. In another type, with reference to FIG. 16 and FIG. 17, the positioning structure comprises a hook and loop 30 disposed on the lower surface of the pad layer 2 and/or on the upper surface of the balancing pad 29, so that the pad layer 2 and the balancing pad 29 may be conveniently connected by means of the hook and loop 30.

Furthermore, in some embodiments, in order to improve the comfort of the elastic cushion 3, a support body is provided between the elastic modules 5 of an edge region of the elastic cushion 3 in the peripheral direction of the elastic cushion 3. As such, the support body of the edge region of the elastic cushion 3 may effectively improve the support strength of the edge region of the elastic cushion 3 together with the elastic modules 5 of the edge region, so as to avoid a collapsing feeling at the edge of the elastic cushion 3 after a person sits on the elastic cushion 3, so that the edge region of the elastic cushion 3 and an inside region of the elastic cushion 3 have substantially the same supporting hardness. This can significantly improve the consistency of the supporting performance of the elastic cushion 3. For example, the support body is interposed between adjacent elastic modules 5 in the peripheral direction among the outermost one round of elastic modules 5 of the elastic cushion 3, or the support body is interposed between each round of adjacent elastic modules 5 in the peripheral direction among the outermost two rounds of elastic modules 5 of the elastic cushion 3. In addition, the support body may be in various types as long as it may be inserted between the adjacent elastic modules 5. For example, the support body may be a rubber post or an elastic module with other structures, such as an inverted cone-shaped elastomer or the like.

In addition, the elastic cushion 3 may be used for any desired application. For example, the elastic cushion 3 may be used as an outdoor mattress and an indoor mattress. For example, the elastic cushion 3 may function as an elastic mattress, a sofa cushion, a chair cushion, and a bench cushion.

In a third aspect, the present disclosure provides a furniture comprising the elastic cushion 3 according to any one of the second aspect described above. Thus, as described above, with the elastic cushion 3, the furniture reduces the cost while having good stability and comfort, thereby improving the overall quality.

The scope of the present disclosure is only limited by the claims. Those skilled in the art, having the benefit of the teachings of the present disclosure, will readily recognize that alternative structures to the structures disclosed herein may be regarded as feasible alternative embodiments, and that the embodiments disclosed herein may be combined to create new embodiments that also fall within the scope of the appended claims.

I claim:

1. An elastic module unit configured for assembling into an elastic cushion (3), the elastic module unit (1) comprises a fixed base plate (4) and a plurality of elastic modules (5) disposed on the fixed base plate (4);

wherein mutually opposite splicing side edges (6) of the fixed base plate (4) are respectively formed with first connecting structures (7) configured to splice together the fixed base plates of the plurality of elastic module units (1) so that the plurality of elastic module units (1) are assembled into an elastic support layer (31);

wherein a side edge of the fixed base plate (4) is provided with a second connecting structure (8) configured to releasably connect an edge fastening device (9) which releasably connects a pad layer (2) of the elastic cushion (3) with the second connecting structure (8), such that the elastic cushion (3) can be formed as an elastic cushion with fully opened sides by means of the edge fastening device (9).

2. The elastic module unit of claim 1, wherein the first connecting structures (7) and the second connecting structures (8) have the same cross-sectional shape and are alternately arranged at an interval on at least one of the splicing side edges (6), and wherein the first connecting structures (7) and the second connecting structures (8) on the other of the splice side edges (6) have different cross- sectional shapes.

3. The elastic module unit of claim 2, wherein an extension length of the second connecting structures (8) is significantly smaller than that of the first connecting structures (7) extending along the extension direction of the splicing side edges (6).

4. The elastic module unit of claim 1, wherein the first connecting structures (7) are disposed at both ends of the splicing side edges (6), wherein an outer end of each of the first connecting structures (7) is provided with the second connecting structure (8), and wherein the second connecting structure (8) comprises a hanging groove (10) formed on a bottom side of the outer end of the first connecting structure (7).

5. The elastic module unit of claim 1, wherein the first connecting structures (7) on the mutually opposed splicing side edges (6) have the same configuration so that the first connecting structures of the fixed base plates of the plurality of elastic module units (1) can be engaged with a splicing rail (11) to splice the plurality of elastic module units (1) together.

6. The elastic module unit of claim 5, wherein the elastic module unit (1) further comprises a splicing rail (11) configured to be engageable with the first connecting structures (7), and the fixed base plates of the elastic module units (1) arranged side by side are spliced together by means of the engagement of the first connecting structures (7) with the splicing rail (11), and wherein the second connecting structures (8) are formed at both ends of the splicing rail (11), respectively.

7. The elastic module unit of claim 5, wherein the first connecting structure (7) comprises a first horizontal side edge (12) extending outwardly from the fixed base plate (4) and a vertical snap tab (13) connected to a suspended end of the first horizontal side edge (12), two opposite longitudinal sides of the splicing rail (11) are respectively formed with snap sliding grooves (14) having groove openings (15) and being configured to enable adjacent first horizontal side edges (12) to enter through the groove openings (15) and engage with adjacent vertical snap tabs (13).

8. The elastic module unit of claim 1, wherein the first connecting structures (7) formed on the opposed splicing side edges (6) have configurations which are shaped differently but can cooperate with each other, so that the fixed base plates of adjacent elastic module units (1) in the plurality of elastic module units (1) can be directly spliced together by means of the engagement of the first connecting structures (7) with each other.

9. The elastic module unit of claim 8, wherein the first connecting structure (7) of the splicing side edge (6) located on one side comprises a first horizontal side edge (12) extending outwards from the fixed base plate (4) and a vertical snap tab (13) connected to the suspended end of the first horizontal side edge (12), and the first connecting structure (7) of the splicing side edge (6) located on the other side comprises a snap sliding groove (14) having a groove opening (15), so that the first horizontal side edge (12) of one elastic module unit (1) of the plurality of elastic module units (1) extends through the groove opening (15) of another adjacent elastic module unit (1) into the snap sliding groove (14), leading to the engagement of the vertical snap tab (13) of said one elastic module unit (1) is in the snap sliding groove (14) of another adjacent elastic module unit (1).

10. The elastic module unit of claim 1, wherein the fixed base plate (4) is formed with a plurality of mounting openings (7) arranged at an interval, each of the plurality of elastic modules (5) is mounted on a corresponding one of the mounting openings (17), and an internal cavity (18) of the elastic module (5) is in communication with the corresponding mounting opening (17), so that the plurality of elastic module units (1) can be successively nested and stacked via a manner of passing each elastic module (5) of one elastic module unit (1) through a corresponding mounting opening (17) of another elastic module unit (1) into the internal cavity (18).

11. The elastic module unit of claim 10, wherein the elastic module (5) comprises a cloth pocket (19) and a spring (20), wherein an interior of the cloth pocket (19) forms the internal cavity (18), one end of the cloth pocket (19) is connected to the fixed base plate (4), and the spring (20) is disposed in the cloth pocket (19) in a pre-compressed state.

12. The elastic module unit of claim 10, wherein the elastic module (5) comprises a spring (20) and a frame (21) having the internal cavity, wherein the frame (21) comprises a top cover (23), a bottom ring connected to the fixed base plate (4), and a plurality of connection strips (24) arranged spaced apart along a circumference of the frame (21) and extending between the top cover and the bottom ring, and the spring is disposed in the frame (21) in a pre-compressed state.

13. An elastic cushion (3) comprising:

a plurality of elastic module units (1) according to claim 1, the fixed base plates (4) of the plurality of elastic module units (1) being spliced together with the first connecting structures (7) to assemble into an elastic support layer (31);

a pad layer (2) laid on the plurality of elastic modules (5) of the elastic support layer (31);

wherein the second connecting structures (8) and an outer edge of the pad layer (2) are connected by the edge fastening device (9) such that the elastic cushion (3) can be formed as an elastic cushion with fully opened sides.

14. The elastic cushion of claim 13, wherein the pad layer (2) comprises a stop ring (25) extending from a lower surface of the pad layer towards the elastic modules (5), the stop ring (25) blocks the outermost elastic module (5), and the stop ring (25) is connected with the second connecting structure (8) via the edge fastening device (9), wherein the pad layer (2) is a material layer that can be folded or rolled up.

15. The elastic cushion of claim 14, wherein the pad layer (2) comprises a plurality of elastic pad blocks (26) arranged in a lengthwise direction of the elastic cushion, the adjacent elastic pad blocks (26) are connected by a thinned flexible hinge portion that comprises a groove (27) formed on a pad layer upper surface and/or a pad layer lower surface of the pad layer (2) and extending in a widthwise direction of the elastic cushion.

16. The elastic cushion of claim 13, wherein the edge fastening device (9) comprises a connecting rope (28) that can be releasably connected.

17. The elastic cushion of claim 13, wherein the elastic cushion (3) comprises a balancing pad (29) which is laid on the plurality of elastic modules (5) in a height direction of the elastic cushion and can limit transverse movements of the plurality of elastic modules (5) in a transverse direction of the elastic cushion, wherein the pad layer (2) is laid on the balancing pad (29) in the height direction.

18. The elastic cushion of claim 17, wherein an upper surface of the balancing pad (29) facing away from the plurality of elastic modules is formed with a plurality of buffering holes (22) which enable an upper portion of the balancing pad to form a buffering layer portion, wherein each of the buffering holes (22) has a hole bottom wall, and each buffering hole (22) is aligned with one corresponding elastic module (5).

19. The elastic cushion of claim 18, wherein the pad layer (2) and the balancing pad (29) are connected by a positioning structure disposed therebetween, wherein the position structure comprises a hook and loop (3) disposed on the pad layer lower surface of the pad layer (2) and/or on a balancing pad upper surface of the balancing pad (29).

20. The elastic cushion of claim 13, wherein a support is provided between the elastic modules (5) in an edge region of the elastic cushion (3) in a peripheral direction of the elastic cushion (3).

* * * * *